US010034116B2

(12) United States Patent
Kadri

(10) Patent No.: US 10,034,116 B2
(45) Date of Patent: Jul. 24, 2018

(54) ACOUSTIC POSITION MEASUREMENT

(71) Applicant: Sonos, Inc., Santa Barbara, CA (US)

(72) Inventor: Romi Kadri, Cambridge, MA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 15/784,952

(22) Filed: Oct. 16, 2017

(65) Prior Publication Data

US 2018/0084363 A1 Mar. 22, 2018

Related U.S. Application Data

(63) Continuation of application No. 15/273,679, filed on Sep. 22, 2016, now Pat. No. 9,794,720.

(51) Int. Cl.
*H04R 29/00* (2006.01)
*H01R 3/00* (2006.01)
(Continued)

(52) U.S. Cl.
CPC ..... *H04S 7/301* (2013.01); *H04R 1/406* (2013.01); *H04R 3/04* (2013.01); *H04R 5/02* (2013.01);
(Continued)

(58) Field of Classification Search
CPC . H04R 3/005; H04R 3/04; H04R 3/12; H04R 1/406; H04R 2201/401;
(Continued)

(56) References Cited

U.S. PATENT DOCUMENTS 4,941,187 A 7/1990 Slater
5,440,644 A 8/1995 Farinelli et al.
(Continued)

FOREIGN PATENT DOCUMENTS

AU 2017100486 A4 6/2017
AU 2017100581 A4 6/2017
(Continued)

OTHER PUBLICATIONS

US 9,299,346, 03/2016, Hart et al. (withdrawn)
(Continued)

*Primary Examiner* — Thang Tran
(74) *Attorney, Agent, or Firm* — McDonnell Boehnen Hulbert & Berghoff LLP

(57) ABSTRACT

Example techniques for acoustic position measurement in an example listening environment are disclosed. An example implementation involves a control device including a first transducer, a playback device including a second transducer, and a network microphone device (NMD) including a microphone array. The NMD determines a first direction of the control device with respect to the NMD based at least in part on a first test sound received at the microphone array from the first transducer and determines a second direction of the playback device with respect to the NMD based at least in part on a second test sound received at the microphone array from the second transducer. The NMD adjusts one or more beamforming parameters of the microphone array thereby causing amplifying sound received at the microphone array from the first direction and attenuating sound received at the microphone array from the second direction.

20 Claims, 9 Drawing Sheets

(51) Int. Cl.

| | |
|---|---|
| ***H04S 7/00*** | (2006.01) |
| ***H04R 3/04*** | (2006.01) |
| ***H04R 1/40*** | (2006.01) |
| ***H04R 5/02*** | (2006.01) |

(52) U.S. Cl.
CPC .... *H04R 2227/005* (2013.01); *H04S 2400/13* (2013.01)

(58) Field of Classification Search
CPC .. H04R 2430/20; H04R 2430/23; H04R 5/02; H04R 2203/12; H04R 2227/005; H04S 7/301; H04S 2400/13
See application file for complete search history.

(56) References Cited

U.S. PATENT DOCUMENTS 5,740,260 A 4/1998 Odom
5,761,320 A 6/1998 Farinelli et al.
5,923,902 A 7/1999 Inagaki
6,032,202 A 2/2000 Lea et al.
6,256,554 B1 7/2001 Dilorenzo
6,301,603 B1 10/2001 Maher et al.
6,311,157 B1 10/2001 Strong
6,404,811 B1 6/2002 Cvetko et al.
6,469,633 B1 10/2002 Wachter
6,522,886 B1 2/2003 Youngs et al.
6,594,347 B1 7/2003 Calder et al.
6,611,537 B1 8/2003 Edens et al.
6,631,410 B1 10/2003 Kowalski et al.
6,757,517 B2 6/2004 Chang
6,778,869 B2 8/2004 Champion
7,130,608 B2 10/2006 Hollstrom et al.
7,130,616 B2 10/2006 Janik
7,143,939 B2 12/2006 Henzerling
7,236,773 B2 6/2007 Thomas
7,295,548 B2 11/2007 Blank et al.
7,391,791 B2 6/2008 Balassanian et al.
7,483,538 B2 1/2009 McCarty et al.
7,571,014 B1 8/2009 Lambourne et al.
7,630,501 B2 * 12/2009 Blank ..... H04S 7/301 381/300
7,643,894 B2 1/2010 Braithwaite et al.
7,657,910 B1 2/2010 McAulay et al.
7,661,107 B1 2/2010 Van et al.
7,702,508 B2 4/2010 Bennett
7,853,341 B2 12/2010 McCarty et al.
7,987,294 B2 7/2011 Bryce et al.
8,014,423 B2 9/2011 Thaler et al.
8,041,565 B1 10/2011 Bhardwaj et al.
8,045,952 B2 10/2011 Qureshey et al.
8,073,125 B2 12/2011 Zhang et al.
8,103,009 B2 1/2012 McCarty et al.
8,234,395 B2 7/2012 Millington et al.
8,239,206 B1 8/2012 Lebeau et al.
8,255,224 B2 8/2012 Singleton et al.
8,290,603 B1 10/2012 Lambourne
8,364,481 B2 1/2013 Strope et al.
8,386,261 B2 2/2013 Mellott et al.
8,423,893 B2 4/2013 Ramsay et al.
8,428,758 B2 4/2013 Naik et al.
8,453,058 B1 5/2013 Coccaro et al.
8,483,853 B1 7/2013 Lambourne
8,484,025 B1 7/2013 Moreno et al.
8,831,761 B2 9/2014 Kemp et al.
8,831,957 B2 9/2014 Taubman et al.
8,938,394 B1 1/2015 Faaborg et al.
8,942,252 B2 1/2015 Balassanian et al.
8,983,844 B1 3/2015 Thomas et al.
9,042,556 B2 5/2015 Kallai et al.
9,094,539 B1 7/2015 Noble
9,215,545 B2 12/2015 Dublin et al.
9,251,793 B2 2/2016 Lebeau et al.
9,262,612 B2 2/2016 Cheyer
9,288,597 B2 3/2016 Carlsson et al.
9,300,266 B2 3/2016 Grokop
9,318,107 B1 4/2016 Sharifi
9,319,816 B1 4/2016 Narayanan
9,412,392 B2 8/2016 Lindahl et al.
9,426,567 B2 8/2016 Lee et al.
9,431,021 B1 8/2016 Scalise et al.
9,443,527 B1 9/2016 Watanabe et al.
9,472,201 B1 10/2016 Sleator
9,472,203 B1 10/2016 Ayrapetian et al.
9,484,030 B1 11/2016 Meaney et al.
9,489,948 B1 11/2016 Chu et al.
9,494,683 B1 11/2016 Sadek
9,509,269 B1 11/2016 Rosenberg
9,514,752 B2 12/2016 Sharifi
9,536,541 B2 1/2017 Chen et al.
9,548,066 B2 1/2017 Jain et al.
9,552,816 B2 1/2017 Vanlund et al.
9,560,441 B1 1/2017 McDonough, Jr. et al.
9,601,116 B2 3/2017 Casado et al.
9,615,170 B2 4/2017 Kirsch et al.
9,615,171 B1 4/2017 O'Neill et al.
9,632,748 B2 4/2017 Faaborg et al.
9,633,186 B2 4/2017 Ingrassia, Jr. et al.
9,633,368 B2 4/2017 Greenzeiger et al.
9,633,660 B2 4/2017 Haughay et al.
9,633,671 B2 4/2017 Giacobello et al.
9,633,674 B2 4/2017 Sinha et al.
9,640,179 B1 5/2017 Hart et al.
9,640,183 B2 5/2017 Jung et al.
9,641,919 B1 5/2017 Poole et al.
9,646,614 B2 5/2017 Bellegarda et al.
9,653,060 B1 5/2017 Hilmes et al.
9,653,075 B1 5/2017 Chen et al.
9,659,555 B1 5/2017 Hilmes et al.
9,672,821 B2 6/2017 Krishnaswamy et al.
9,685,171 B1 6/2017 Yang
9,691,378 B1 6/2017 Meyers et al.
9,691,379 B1 6/2017 Mathias et al.
9,697,826 B2 7/2017 Sainath et al.
9,697,828 B1 7/2017 Prasad et al.
9,698,999 B2 7/2017 Mutaci et al.
9,704,478 B1 7/2017 Vitaladevuni et al.
9,721,568 B1 8/2017 Polansky et al.
9,721,570 B1 8/2017 Beal et al.
9,728,188 B1 8/2017 Rosen et al.
9,734,822 B1 8/2017 Sundaram et al.
9,747,011 B2 8/2017 Lewis et al.
9,747,899 B2 8/2017 Pogue et al.
9,747,920 B2 8/2017 Ayrapetian et al.
9,747,926 B2 8/2017 Sharifi et al.
9,754,605 B1 9/2017 Chhetri
9,826,306 B2 11/2017 Lang
2001/0042107 A1 11/2001 Palm
2002/0022453 A1 2/2002 Balog et al.
2002/0026442 A1 2/2002 Lipscomb et al.
2002/0034280 A1 3/2002 Infosino
2002/0072816 A1 6/2002 Shdema et al.
2002/0124097 A1 9/2002 Isely et al.
2003/0157951 A1 8/2003 Hasty
2004/0024478 A1 2/2004 Hans et al.
2005/0195988 A1 9/2005 Tashev et al.
2005/0283330 A1 12/2005 Laraia et al.
2006/0147058 A1 7/2006 Wang
2006/0190968 A1 8/2006 Jung et al.
2006/0247913 A1 11/2006 Huerta et al.
2007/0018844 A1 1/2007 Sutardja
2007/0019815 A1 1/2007 Asada et al.
2007/0033043 A1 2/2007 Hyakumoto
2007/0076131 A1 4/2007 Li et al.
2007/0140058 A1 6/2007 McIntosh et al.
2007/0142944 A1 6/2007 Goldberg et al.
2008/0090537 A1 4/2008 Sutardja
2008/0248797 A1 10/2008 Freeman et al.
2009/0003620 A1 1/2009 McKillop et al.
2009/0005893 A1 1/2009 Sugii et al.
2009/0018828 A1 1/2009 Nakadai et al.
2009/0076821 A1 3/2009 Brenner et al.
2009/0197524 A1 8/2009 Haff et al.
2009/0228919 A1 9/2009 Zott et al.

(56) References Cited

U.S. PATENT DOCUMENTS

2009/0238377 A1 9/2009 Ramakrishnan et al.
2009/0326949 A1 12/2009 Douthitt et al.
2010/0014690 A1* 1/2010 Wolff ..... H04R 3/005 381/92
2010/0023638 A1 1/2010 Bowman
2010/0075723 A1 3/2010 Min et al.
2010/0179874 A1 7/2010 Higgins et al.
2010/0211199 A1 8/2010 Naik et al.
2011/0033059 A1 2/2011 Bhaskar et al.
2011/0091055 A1* 4/2011 LeBlanc ..... H04S 7/301 381/303
2011/0145581 A1 6/2011 Malhotra et al.
2011/0267985 A1 11/2011 Wilkinson et al.
2011/0280422 A1 11/2011 Neumeyer et al.
2011/0299706 A1* 12/2011 Sakai ..... H04S 7/301 381/303
2012/0131125 A1 5/2012 Seidel et al.
2012/0163603 A1 6/2012 Abe et al.
2012/0177215 A1 7/2012 Bose et al.
2012/0297284 A1 11/2012 Matthews, III et al.
2013/0006453 A1 1/2013 Wang et al.
2013/0024018 A1 1/2013 Chang et al.
2013/0058492 A1* 3/2013 Silzle ..... H04R 5/027 381/59
2013/0066453 A1 3/2013 Seefeldt
2013/0148821 A1 6/2013 Sorensen
2013/0179173 A1 7/2013 Lee et al.
2013/0183944 A1 7/2013 Mozer et al.
2013/0191122 A1 7/2013 Mason
2013/0216056 A1 8/2013 Thyssen
2013/0317635 A1 11/2013 Bates et al.
2013/0329896 A1 12/2013 Krishnaswamy et al.
2013/0331970 A1 12/2013 Beckhardt et al.
2013/0343567 A1 12/2013 Triplett et al.
2014/0003611 A1* 1/2014 Mohammad ..... H04R 3/005 381/66
2014/0003635 A1* 1/2014 Mohammad ..... G10K 11/16 381/306
2014/0006026 A1 1/2014 Lamb et al.
2014/0064501 A1 3/2014 Olsen et al.
2014/0075306 A1 3/2014 Rega
2014/0094151 A1 4/2014 Klappert et al.
2014/0100854 A1 4/2014 Chen et al.
2014/0167931 A1 6/2014 Lee et al.
2014/0195252 A1 7/2014 Gruber et al.
2014/0244013 A1 8/2014 Reilly
2014/0258292 A1 9/2014 Thramann et al.
2014/0270282 A1* 9/2014 Tammi ..... H04R 5/02 381/300
2014/0274185 A1 9/2014 Luna et al.
2014/0363022 A1 12/2014 Dizon et al.
2015/0010169 A1 1/2015 Popova et al.
2015/0016642 A1* 1/2015 Walsh ..... H04S 7/301 381/307
2015/0086034 A1 3/2015 Lombardi et al.
2015/0104037 A1 4/2015 Lee et al.
2015/0154976 A1 6/2015 Mutagi
2015/0180432 A1 6/2015 Gao et al.
2015/0189438 A1 7/2015 Hampiholi et al.
2015/0200454 A1 7/2015 Heusdens et al.
2015/0222987 A1 8/2015 Angel, Jr. et al.
2015/0228274 A1 8/2015 Leppänen et al.
2015/0253292 A1* 9/2015 Larkin ..... G01N 29/11 73/571
2015/0253960 A1 9/2015 Lin et al.
2015/0271593 A1 9/2015 Sun et al.
2015/0280676 A1 10/2015 Holman et al.
2015/0296299 A1 10/2015 Klippel et al.
2015/0302856 A1 10/2015 Kim et al.
2015/0341406 A1 11/2015 Rockefeller et al.
2015/0363061 A1 12/2015 De Nigris, III et al.
2015/0363401 A1 12/2015 Chen et al.
2015/0371657 A1 12/2015 Gao et al.
2015/0380010 A1 12/2015 Srinivasan
2016/0007116 A1 1/2016 Holman
2016/0021458 A1 1/2016 Johnson et al.
2016/0029142 A1 1/2016 Isaac et al.
2016/0036962 A1 2/2016 Rand et al.
2016/0042748 A1 2/2016 Jain et al.
2016/0057522 A1 2/2016 Choisel et al.
2016/0077710 A1 3/2016 Lewis et al.
2016/0093304 A1 3/2016 Kim et al.
2016/0098393 A1 4/2016 Hebert
2016/0157035 A1 6/2016 Russell et al.
2016/0173578 A1 6/2016 Sharma et al.
2016/0212538 A1 7/2016 Fullam et al.
2016/0225385 A1 8/2016 Hammarqvist
2016/0232451 A1 8/2016 Scherzer
2016/0234204 A1 8/2016 Rishi et al.
2016/0239255 A1 8/2016 Chavez et al.
2016/0260431 A1 9/2016 Newendorp et al.
2016/0314782 A1 10/2016 Klimanis
2016/0352915 A1 12/2016 Gautama
2016/0353218 A1 12/2016 Starobin et al.
2017/0003931 A1 1/2017 Dvortsov et al.
2017/0026769 A1* 1/2017 Patel ..... H04R 3/12
2017/0060526 A1 3/2017 Barton et al.
2017/0070478 A1 3/2017 Park et al.
2017/0076720 A1 3/2017 Gopalan et al.
2017/0078824 A1 3/2017 Heo
2017/0084292 A1 3/2017 Yoo
2017/0090864 A1 3/2017 Jorgovanovic
2017/0092278 A1 3/2017 Evermann et al.
2017/0092297 A1 3/2017 Sainath et al.
2017/0103755 A1 4/2017 Jeon et al.
2017/0125037 A1 5/2017 Shin
2017/0177585 A1 6/2017 Rodger et al.
2017/0178662 A1 6/2017 Ayrapetian et al.
2017/0193999 A1 7/2017 Aleksic et al.
2017/0206896 A1 7/2017 Ko et al.
2017/0236512 A1 8/2017 Williams et al.
2017/0242653 A1 8/2017 Lang et al.
2017/0270919 A1 9/2017 Parthasarathi et al.

FOREIGN PATENT DOCUMENTS

EP 1349146 A1 10/2003
EP 1389853 A1 2/2004
EP 2351021 B1 9/2017
JP 2001236093 A 8/2001
JP 2004347943 A 12/2004
JP 2004354721 A 12/2004
JP 2005284492 A 10/2005
JP 2008079256 A 4/2008
JP 2008158868 A 7/2008
JP 2010141748 A 6/2010
JP 2013037148 A 2/2013
JP 2014071138 A 4/2014
JP 2014137590 A 7/2014
KR 20100111071 A 10/2010
WO 200153994 7/2001
WO 2003093950 A2 11/2003
WO 2015037396 A1 3/2015
WO 2015178950 A1 11/2015
WO 2016033364 A1 3/2016
WO 2017039632 A1 3/2017

OTHER PUBLICATIONS

Notice of Allowance dated Dec. 15, 2017, issued in connection with U.S. Appl. No. 15/223,218, filed Jul. 29, 2016, 7 pages.
Notice of Allowance dated Aug. 16, 2017, issued in connection with U.S. Appl. No. 15/098,892, filed Apr. 14, 2016, 9 pages.
Notice of Allowance dated Aug. 17, 2017, issued in connection with U.S. Appl. No. 15/131,244, filed Apr. 18, 2016, 9 pages.
Notice of Allowance dated Aug. 22, 2017, issued in connection with U.S. Appl. No. 15/273,679, filed Sep. 22, 2016, 5 pages.
Notice of Allowance dated Jan. 22, 2018, issued in connection with U.S. Appl. No. 15/178,180, filed Jun. 9, 2016, 9 pages.
Notice of Allowance dated Dec. 29, 2017, issued in connection with U.S. Appl. No. 15/131,776, filed Apr. 18, 2016, 13 pages.

(56) References Cited

OTHER PUBLICATIONS

Palm, Inc., "Handbook for the Palm VII Handheld," May 2000, 311 pages.
Presentations at WinHEC 2000, May 2000, 138 pages.
Tsiami et al. "Experiments in acoustic source localization using sparse arrays in adverse indoors environments", 2014 22nd European Signal Processing Conference, Sep. 1, 2014, 5 pages.
United States Patent and Trademark Office, U.S. Appl. No. 60/490,768, filed Jul. 28, 2003, entitled "Method for synchronizing audio playback between multiple networked devices," 13 pages.
United States Patent and Trademark Office, U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Vacher at al. "Recognition of voice commands by multisource ASR and noise cancellation in a smart home environment" Signal Processing Conference 2012 Proceedings of the 20th European, IEEE, Aug. 27, 2012, 5 pages.
Xiao et al. "A Learning-Based Approach to Direction of Arrival Estimation in Noisy and Reverberant Environments," 2015 IEEE International Conference on Acoustics, Speech and Signal Processing, Apr. 19, 2015, 5 pages.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.
Notice of Allowance dated Jun. 14, 2017, issued in connection with U.S. Appl. No. 15/282,554, filed Sep. 30, 2016, 11 pages.
Notice of Allowance dated Feb. 14, 2017, issued in connection with U.S. Appl. No. 15/229,855, filed Aug. 5, 2016, 11 pages.
Notice of Allowance dated Aug. 14, 2017, issued in connection with U.S. Appl. No. 15/098,867, filed Apr. 14, 2016, 10 pages.
Notice of Allowance dated Jul. 12, 2017, issued in connection with U.S. Appl. No. 15/098,805, filed Apr. 14, 2016, 8 pages.
Notice of Allowance dated Dec. 4, 2017, issued in connection with U.S. Appl. No. 15/277,810, filed Sep. 27, 2016, 5 pages.
Non-Final Office Action dated Sep. 6, 2017, issued in connection with U.S. Appl. No. 15/131,254, filed Apr. 18, 2016, 13 pages.
Non-Final Office Action dated Feb. 6, 2018, issued in connection with U.S. Appl. No. 15/237,133, filed Aug. 15, 2016, 6 pages.
Non-Final Office Action dated Feb. 6, 2018, issued in connection with U.S. Appl. No. 15/211,689, filed Jul. 15, 2016, 32 pages.
Non-Final Office Action dated Jun. 30, 2017, issued in connection with U.S. Appl. No. 15/277,810, filed Sep. 27, 2016, 13 pages.
Non-Final Office Action dated Feb. 26, 2017, issued in connection with U.S. Appl. No. 15/438,744, filed Feb. 21, 2017, 12 pages.
Non-Final Office Action dated Jan. 26, 2017, issued in connection with U.S. Appl. No. 15/098,867, filed Apr. 14, 2016, 16 pages.
Non-Final Office Action dated Jul. 25, 2017, issued in connection with U.S. Appl. No. 15/273,679, filed Jul. 22, 2016, 11 pages.
Non-Final Office Action dated Feb. 20, 2018, issued in connection with U.S. Appl. No. 15/211,748, filed Jul. 15, 2016, 31 pages.
Non-Final Office Action dated Apr. 19, 2017, issued in connection with U.S. Appl. No. 15/131,776, filed Apr. 18, 2016, 12 pages.
Non-Final Office Action dated Sep. 14, 2017, issued in connection with U.S. Appl. No. 15/178,180, filed Jun. 9, 2016, 16 pages.
Non-Final Office Action dated Jan. 13, 2017, issued in connection with U.S. Appl. No. 15/098,805, filed Apr. 14, 2016, 11 pages.
Non-Final Office Action dated Dec. 12, 2016, issued in connection with U.S. Appl. No. 15/098,718, filed Apr. 14, 2016, 11 pages.
Non-Final Office Action dated Jan. 10, 2018, issued in connection with U.S. Appl. No. 15/438,725, filed Feb. 21, 2017, 15 pages.
Non-Final Office Action dated Jan. 10, 2018, issued in connection with U.S. Appl. No. 15/229,868, filed Aug. 5, 2016, 13 pages.
Non-Final Office Action dated Jan. 10, 2018, issued in connection with U.S. Appl. No. 15/098,718, filed Apr. 14, 2016, 15 pages.
Non-Final Office Action dated Mar. 9, 2017, issued in connection with U.S. Appl. No. 15/098,760, filed Apr. 14, 2016, 13 pages.
Non-Final Office Action dated Feb. 8, 2017, issued in connection with U.S. Appl. No. 15/098.892, filed Apr. 14, 2016, 17 pages.
Non-Final Office Action dated Feb. 7, 2017, issued in connection with U.S. Appl. No. 15/131,244, filed Apr. 18, 2016, 12 pages.
AudioTron Quick Start Guide, Version 1.0, Mar. 2001, 24 pages.
AudioTron Reference Manual, Version 3.0, May 2002, 70 pages.
AudioTron Setup Guide, Version 3.0, May 2002, 38 pages.
Bluetooth. "Specification of the Bluetooth System: The ad hoc Scatternet for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Corrected Notice of Allowability dated Mar. 8, 2017, issued in connection with U.S. Appl. No. 15/229,855, filed Aug. 5, 2016, 6 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
European Patent Office, European Extended Search Report dated Oct. 30, 2017, issued in connection with EP Application No. 17174435.2, 11 pages.
Final Office Action dated Oct. 6, 2017, issued in connection with U.S. Appl. No. 15/098,760, filed Apr. 14, 2016, 25 pages.
Final Office Action dated Aug. 11, 2017, issued in connection with U.S. Appl. No. 15/131,776, filed Apr. 18, 2016, 7 pages.
Final Office Action dated Jun. 15, 2017, issued in connection with U.S. Appl. No. 15/098,718, filed Apr. 14, 2016, 15 pages.
Fiorenza Arisio et al. "Deliverable 1.1 User Study, analysis of requirements and definition of the application task," May 31, 2012, http://dirha.fbk.eu/sites/dirha.fbk.eu/files/docs/DIRHA_D1.1., 31 pages.
Freiberger, Karl, "Development and Evaluation of Source Localization Algorithms for Coincident Microphone Arrays," Diploma Thesis, Apr. 1, 2010, 106 pages.
International Searching Authority, International Search Report and Written Opinion dated Nov. 22, 2017, issued in connection with International Application No. PCT/US2017/054063, filed Sep. 28, 2017, 11 pages.
International Searching Authority, International Search Report and Written Opinion dated May 23, 2017, issued in connection with International Application No. PCT/US2017/018739, filed Feb. 21, 2017, 10 pages.
International Searching Authority, International Search Report and Written Opinion dated Oct. 23, 2017, issued in connection with International Application No. PCT/US2017/042170, filed Jul. 14, 2017, 15 pages.
International Searching Authority, International Search Report and Written Opinion dated Oct. 24, 2017, issued in connection with International Application No. PCT/US2017/042227, filed Jul. 14, 2017, 16 pages.
International Searching Authority, International Search Report and Written Opinion dated May 30, 2017, issued in connection with International Application No. PCT/US2017/018728, filed Feb. 21, 2017, 11 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 http://www.reviewsonline.com/articles/961906864.htm retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Morales-Cordovilla et al. "Room Localization for Distant Speech Recognition," Proceedings of Interspeech 2014, Sep. 14, 2014, 4 pages.
Non-Final Office Action dated Jun. 1, 2017, issued in connection with U.S. Appl. No. 15/223,218, filed Jul. 29, 2016, 7 pages.
Non-Final Office Action dated Nov. 2, 2017, issued in connection with U.S. Appl. No. 15/584,782, filed May 2, 2017, 11 pages.

(56) References Cited

OTHER PUBLICATIONS

Non-Final Office Action dated Nov. 3, 2017, issued in connection with U.S. Appl. No. 15/438,741, filed Feb. 21, 2017, 11 pages.

* cited by examiner

ACOUSTIC POSITION MEASUREMENT

CROSS-REFERENCE TO RELATED APPLICATIONS

This application claims priority under 35 U.S.C. § 120 to, and is a continuation of, U.S. non-provisional patent application Ser. No. 15/273,679, filed on Sep. 22, 2016, entitled "Acoustic Position Measurement," which is incorporated herein by reference in its entirety.

The present application incorporates herein by reference the entire contents of U.S. application Ser. No. 15/098,867, filed Apr. 14, 2016, titled "Default Playback Device Designation," U.S. application Ser. No. 15/005,853, filed Jan. 25, 2016, titled, "Calibration with Particular Locations," and U.S. application Ser. No. 14/871,494, filed Sep. 30, 2015, titled, "Spatial Mapping of Audio Playback Devices in a Listening Environment."

FIELD OF THE DISCLOSURE

This disclosure is related to consumer goods and, more particularly, to methods, systems, products, features, services, and other elements directed to media playback or some aspect thereof.

BACKGROUND

Options for accessing and listening to digital audio in an out-loud setting were limited until in 2003, when SONOS, Inc. filed for one of its first patent applications, titled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
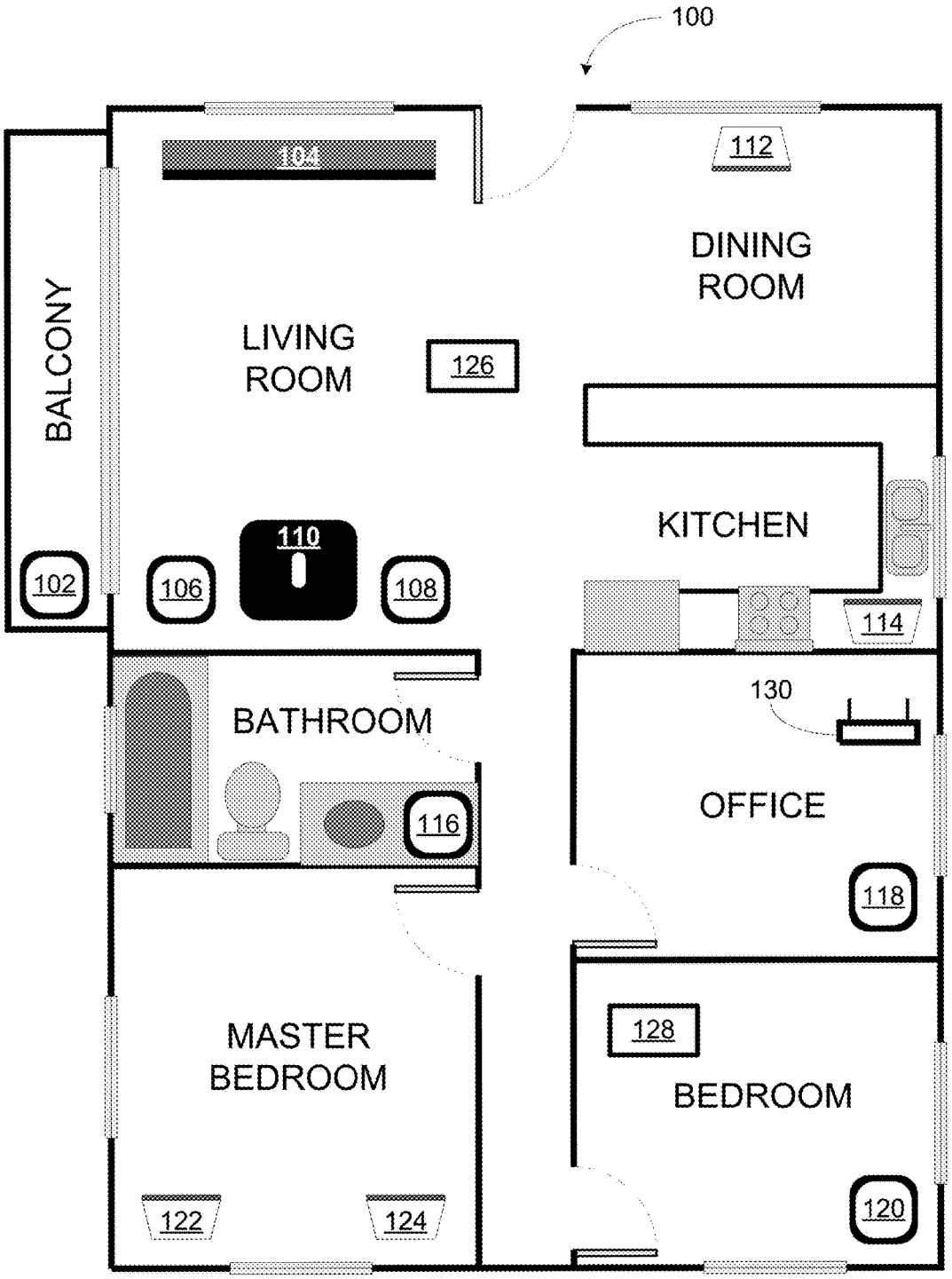
FIG. 1 shows an example media playback system configuration in which certain embodiments may be practiced.

The drawings are for purpose of illustrating example embodiments, but it is understood that the inventions are not limited to the arrangements and instrumentalities shown in the drawings.

DETAILED DESCRIPTION

I. Overview

Certain embodiments described herein enable acoustic position measurement of speaker-equipped devices relative to microphone-equipped devices of a media playback system to provide a media playback system with improved spatial awareness. An example speaker-equipped device may be a control device (e.g., a smartphone or tablet computer), a networked microphone device (NMD), or a playback device that plays audio. An example listening environment may be a home theater, living room, bedroom, or even the outdoor space of a home. An example NMD may be a SONOS® playback device, server, or system capable of receiving voice inputs via a microphone. Additionally, an NMD may be a device other than a SONOS® playback device, server, or system (e.g., AMAZON® ECHO®, APPLE® IPHONE®) capable of receiving voice inputs via a microphone. U.S. application Ser. No. 15/098,867 entitled, "Default Playback Device Designation," which is hereby incorporated by reference, provides examples of voice-enabled household architectures.

Knowing the position of the playback devices in a listening environment may be useful in providing the best audio experience. In some instances, placing a playback device too close or too far from a listener or orienting the direction of the playback device sub-optimally may impact quality of the audio sound heard by a listener. As an example, the audio may sound distorted, undesirably attenuated, or undesirably amplified based on the position of the listener relative to the playback device. By knowing the position of the playback devices, the audio playback device can adjust the audio sound to optimize the audio experience. Additionally or alternatively, knowing the position of the playback devices, a listener can readjust the position of the playback devices to optimize the audio experience. Determining the position of the playback devices may sometimes be referred to as spatial mapping. U.S. application Ser. No. 14/871,494 entitled, "Spatial Mapping of Audio Playback Devices in a Listening Environment," which is hereby incorporated by reference, provides example spatial mapping techniques.

In some embodiments, a control device may display a user interface to facilitate the calibration of a playback device or an NMD for spatial mapping. Some calibration procedures involve control devices detecting sound waves (e.g., one or more test sounds) emitted by one or more playback devices of the media playback system. Within examples, some calibration procedures may include spectral and/or spatial calibration. For instance, a processing device, such as a computing device that is communicatively coupled to the media playback system, may determine a first calibration that configures one or more playback devices to a given listening area spectrally. Such a calibration may generally help offset acoustic characteristics of the listening environment and may be applied during certain use cases, such as music playback. The processing device may also determine a second calibration that configures the one or more playback devices to a given listening area spatially (and perhaps also spectrally). Such a calibration may configure the one or more playback devices to one or more particular locations within the listening environment (e.g., one or more preferred listening positions, such as favorite seating location), perhaps by adjusting time-delay and/or loudness for those particular locations. This second calibration may be applied during other use cases, such as home theater. U.S. application Ser. No. 15/005,853 entitled, "Calibration with Particular Locations," which is hereby incorporated by reference, provides example techniques to facilitate calibration of the media playback system.

Additionally, it may be beneficial to determine one or more calibrations for the media playback system based on the position of a speaker-equipped device (e.g., control device) relative to one or more microphone-equipped devices (e.g., playback devices) to improve calibration techniques and provide the best audio experience. Example calibration procedures may involve a microphone-equipped device detecting sound waves (e.g., one or more test sounds) emitted by a speaker-equipped device (e.g., control device) of the media playback system. The microphone-equipped device (or any other device or system described herein) may analyze the detected sound waves to determine the position of the speaker-equipped device relative to one or more microphone-equipped devices.

In some embodiments, determining the position of the speaker-equipped device relative to the microphone-equipped device may involve determining an angle of the speaker-equipped device relative to the microphone-equipped device. Additionally or alternatively, determining the position of the speaker-equipped device relative to the microphone-equipped device may involve determining a distance between the speaker-equipped device and the microphone equipped device.

By knowing the position of the speaker-equipped device relative to one or more microphone-equipped devices, the media playback system may adjust one or more audio configuration parameters to further optimize and improve audio experience. For example, based on the position of the control device relative to one or more microphone-equipped devices, audio configuration parameters such as equalization, gain, and attenuation, of one or more playback devices can be adjusted or calibrated through audio processing algorithms, filters, disabling playback devices, enabling playback devices, and the sort. Furthermore, by knowing the position of the speaker-equipped device relative to one or more microphone-equipped devices, the microphone-equipped device may (i) facilitate discovery of a particular location within the listening environment that provides the best audio experience, (ii) facilitate adjustment of the position of the speaker-equipped device (e.g., control device) during an audio calibration procedure to optimize the audio experience, and/or (iii) facilitate amplification of sound in the direction of a speaker-equipped device or a preferred location within a listening environment.

While some examples described herein may refer to functions performed by given actors such as "users," "listeners," and/or other entities, it should be understood that this is for purposes of explanation only. The claims should not be interpreted to require action by any such example actor unless explicitly required by the language of the claims themselves. It will be understood by one of ordinary skill in the art that this disclosure includes numerous other embodiments.

II. Example Operating Environment

FIG. 1 shows an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102-124, control devices 126 and 128, and a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
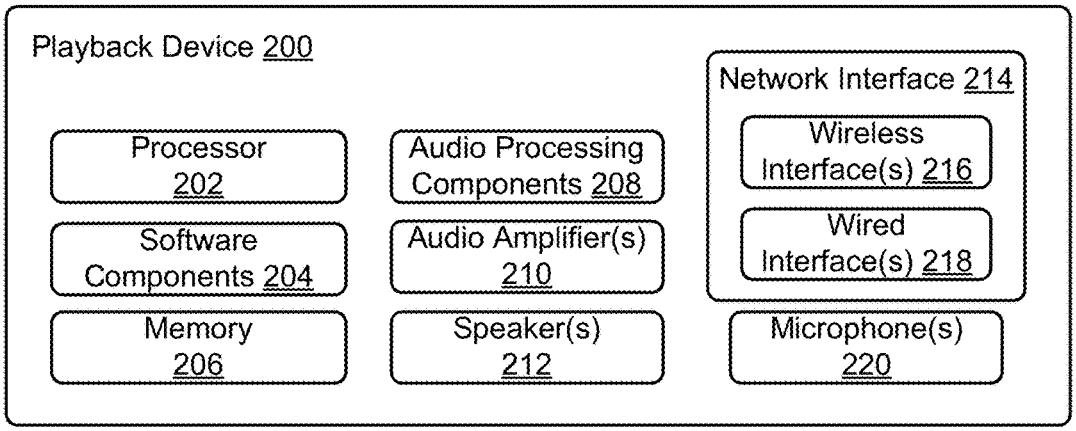
FIG. 2 shows a functional block diagram of an example playback device.

FIG. 2 shows a functional block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, a network interface 214 including wireless interface(s) 216 and wired interface(s) 218, and microphone(s) 220. In one case, the playback device 200 may not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection) or the network interface 214.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

The microphone(s) 220 may be arranged to detect sound in the environment of the playback device 200. For instance, the microphone(s) may be mounted on an exterior wall of a housing of the playback device. The microphone(s) may be any type of microphone now known or later developed such as a condenser microphone, electret condenser microphone, or a dynamic microphone. The microphone(s) may be sensitive to a portion of the frequency range of the speaker(s) 220. In some embodiments the microphone(s) 220 may include an array of microphones, where one or more processors associated with the microphone (e.g., processor 202 or other processor(s)) are configured to implement beamforming capabilities with the array of microphones. Additionally, or alternatively, one or more of the speaker(s) 212 may operate in reverse as the microphone(s) 220. In some aspects, the playback device 200 might not include the microphone(s) 220.

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (e.g., a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being playing by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
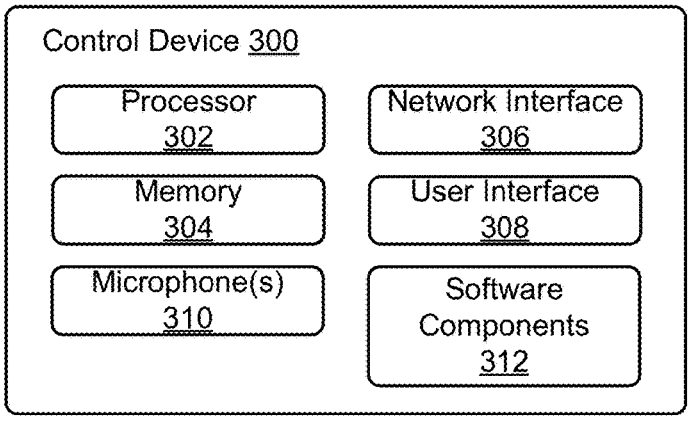
FIG. 3 shows a functional block diagram of an example control device.

FIG. 3 shows a functional block diagram of an example control device 300 that may be configured to be one or both of the control devices 126 and 128 of the media playback system 100. As shown, the control device 300 may include a processor 302, memory 304, a network interface 306, a user interface 308, microphone(s) 310, and software components 312. In one example, the control device 300 may be a dedicated controller for the media playback system 100. In another example, the control device 300 may be a network device on which media playback system controller application software may be installed, such as for example, an iPhone™, iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be data storage that can be loaded with one or more of the software components executable by the processor 302 to perform those functions. The memory 304 may also be configured to store the media playback system controller application software and other data associated with the media playback system 100 and the user.

In one example, the network interface 306 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

Control device 300 may include microphone(s) 310. Microphone(s) 310 may be arranged to detect sound in the environment of the control device 300. Microphone(s) 310 may be any type of microphone now known or later developed such as a condenser microphone, electret condenser microphone, or a dynamic microphone. The microphone(s) may be sensitive to a portion of a frequency range. Two or more microphones 310 may be arranged to capture location information of an audio source (e.g., voice, audible sound) and/or to assist in filtering background noise.

Figure 4:
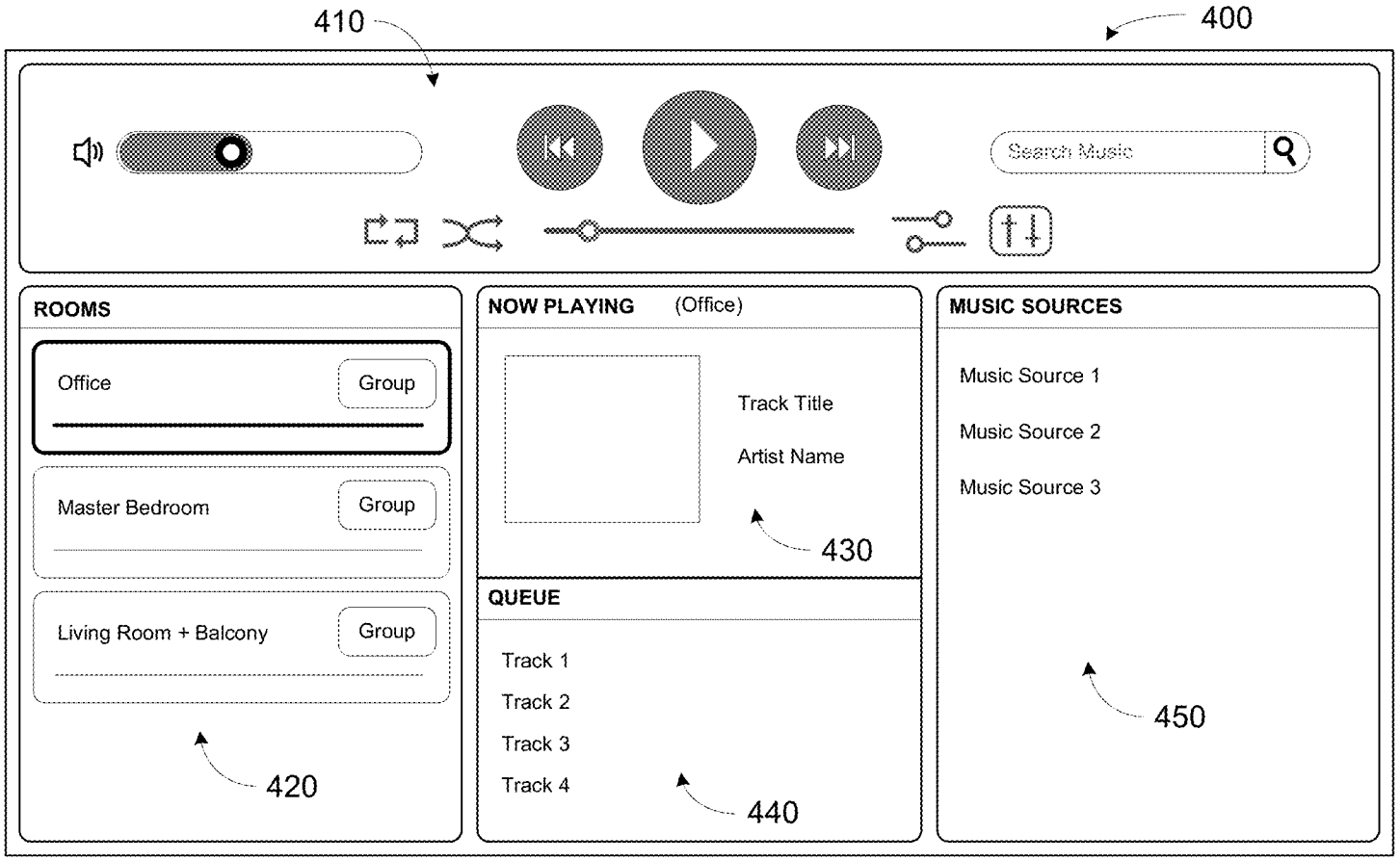
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The user interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the user interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the user interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the user interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g. according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

e. Example Plurality of Networked Devices

Figure 5:
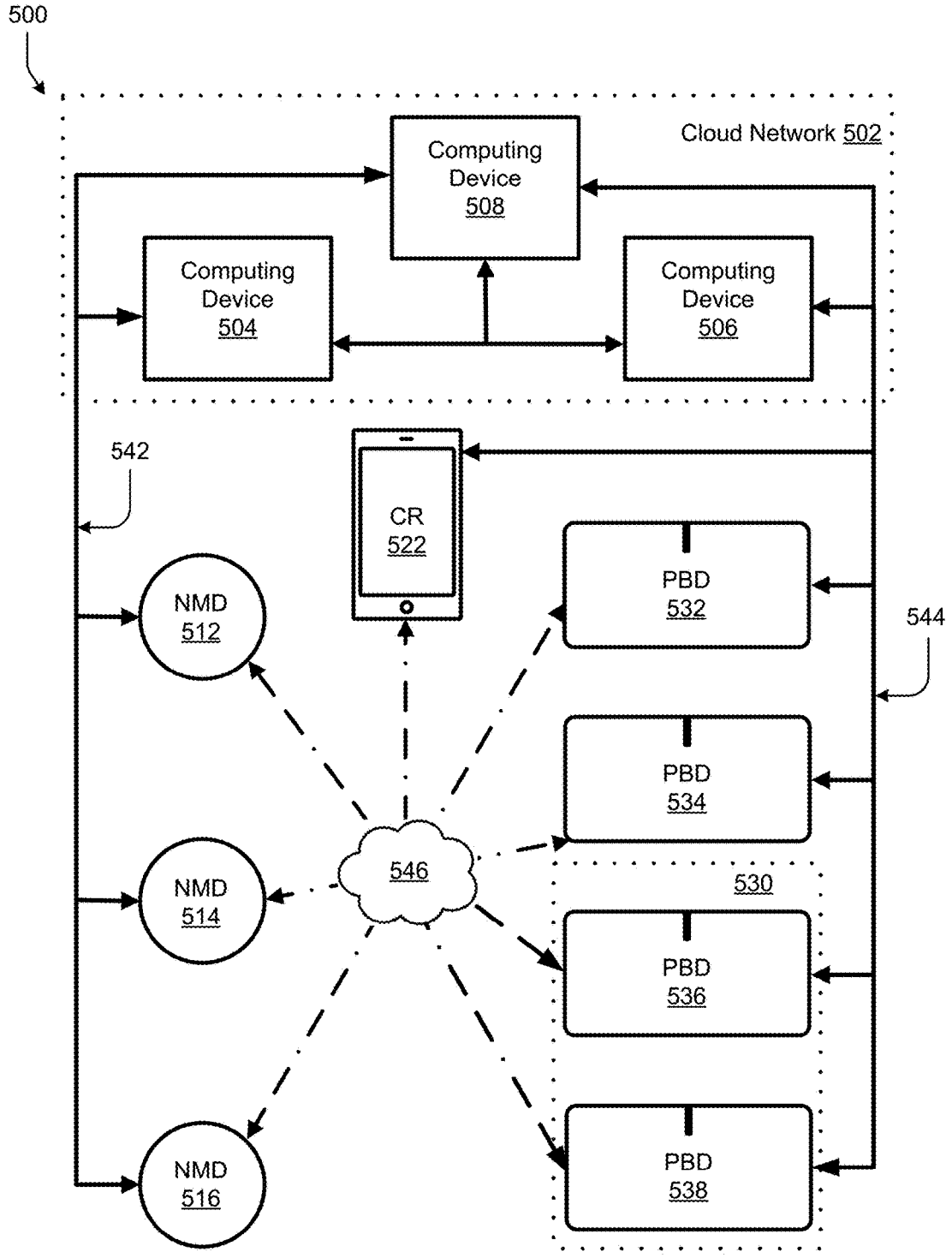
FIG. 5 shows an example plurality of network devices.

FIG. 5 shows an example plurality of devices 500 that may be configured to provide an audio playback experience based on voice control. One having ordinary skill in the art will appreciate that the devices shown in FIG. 5 are for illustrative purposes only, and variations including different and/or additional devices may be possible. As shown, the plurality of devices 500 includes computing devices 504, 506, and 508; network microphone devices (NMDs) 512, 514, and 516; playback devices (PBDs) 532, 534, 536, and 538; and a controller device (CR) 522.

Each of the plurality of devices 500 may be network-capable devices that can establish communication with one or more other devices in the plurality of devices according to one or more network protocols, such as NFC, Bluetooth, Ethernet, and IEEE 802.11, among other examples, over one or more types of networks, such as wide area networks (WAN), local area networks (LAN), and personal area networks (PAN), among other possibilities.

As shown, the computing devices 504, 506, and 508 may be part of a cloud network 502. The cloud network 502 may include additional computing devices. In one example, the computing devices 504, 506, and 508 may be different servers. In another example, two or more of the computing devices 504, 506, and 508 may be modules of a single server. Analogously, each of the computing device 504, 506, and 508 may include one or more modules or servers. For ease of illustration purposes herein, each of the computing devices 504, 506, and 508 may be configured to perform particular functions within the cloud network 502. For instance, computing device 508 may be a source of audio content for a streaming music service.

As shown, the computing device 504 may be configured to interface with NMDs 512, 514, and 516 via communication path 542. NMDs 512, 514, and 516 may be components of one or more "Smart Home" systems. In one case, NMDs 512, 514, and 516 may be physically distributed throughout a household, similar to the distribution of devices shown in FIG. 1. In another case, two or more of the NMDs 512, 514, and 516 may be physically positioned within relative close proximity of one another. Communication path 542 may comprise one or more types of networks, such as a WAN including the Internet, LAN, and/or PAN, among other possibilities.

In one example, one or more of the NMDs 512, 514, and 516 may be devices configured primarily for audio detection. In another example, one or more of the NMDs 512, 514, and 516 may be components of devices having various primary utilities. For instance, as discussed above in connection to FIGS. 2 and 3, one or more of NMDs 512, 514, and 516 may be the microphone(s) 220 of playback device 200 or the microphone(s) 310 of network device 300. Further, in some cases, one or more of NMDs 512, 514, and 516 may be the playback device 200 or network device 300. In an example, one or more of NMDs 512, 514, and/or 516 may include multiple microphones arranged in a microphone array.

As shown, the computing device 506 may be configured to interface with CR 522 and PBDs 532, 534, 536, and 538 via communication path 544. In one example, CR 522 may be a network device such as the network device 200 of FIG. 2. Accordingly, CR 522 may be configured to provide the controller interface 400 of FIG. 4 or a similar controller interface for controlling one or more of PBDs 532, 534, 536, and 538 and/or NMDs 512, 514, and 516. Similarly, PBDs 532, 534, 536, and 538 may be playback devices such as the playback device 300 of FIG. 3. As such, PBDs 532, 534, 536, and 538 may be physically distributed throughout a household as shown in FIG. 1. For illustration purposes, PBDs 536 and 538 may be part of a bonded zone 530, while PBDs 532 and 534 may be part of their own respective zones. As described above, the PBDs 532, 534, 536, and 538 may be dynamically bonded, grouped, unbonded, and ungrouped. Communication path 544 may comprise one or more types of networks, such as a WAN including the Internet, LAN, and/or PAN, among other possibilities.

In one example, as with NMDs 512, 514, and 516, CR 522 and PBDs 532, 534, 536, and 538 may also be components of one or more "Smart Home" systems. In one case, PBDs 532, 534, 536, and 538 may be distributed throughout the same household as the NMDs 512, 514, and 516. Further, as suggested above, one or more of PBDs 532, 534, 536, and 538 may be one or more of NMDs 512, 514, and 516 (or vice versa).

The NMDs 512, 514, and 516 may be part of a local area network, and the communication path 542 may include an access point that links the local area network of the NMDs 512, 514, and 516 to the computing device 504 over a WAN (communication path not shown). Likewise, each of the NMDs 512, 514, and 516 may communicate with each other via such an access point.

Similarly, CR 522 and PBDs 532, 534, 536, and 538 may be part of a local area network and/or a local playback network as discussed in previous sections, and the communication path 544 may include an access point that links the local area network and/or local playback network of CR 522 and PBDs 532, 534, 536, and 538 to the computing device 506 over a WAN. As such, each of the CR 522 and PBDs 532, 534, 536, and 538 may also communicate with each over such an access point.

In one example, a single access point may include communication paths 542 and 544. In an example, each of the NMDs 512, 514, and 516, CR 522, and PBDs 532, 534, 536, and 538 may access the cloud network 502 via the same access point for a household.

As shown in FIG. 5, each of the NMDs 512, 514, and 516, CR 522, and PBDs 532, 534, 536, and 538 may also directly communicate with one or more of the other devices via communication means 546. Communication means 546 as described herein may involve one or more forms of communication between the devices, according to one or more network protocols, over one or more types of networks, and/or may involve communication via one or more other network devices. For instance, communication means 546 may include one or more of for example, Bluetooth™ (IEEE 802.15), NFC, Wireless direct, and/or Proprietary wireless, among other possibilities.

In one example, CR 522 may communicate with NMD 512 over Bluetooth™, and communicate with PBD 534 over another local area network. In another example, NMD 514 may communicate with CR 522 over another local area network, and communicate with PBD 536 over Bluetooth. In a further example, each of the PBDs 532, 534, 536, and 538 may communicate with each other according to a spanning tree protocol over a local playback network (or other routing and/or communication protocol), while each communicating with CR 522 over a local area network, different from the local playback network. Other examples are also possible.

In some cases, communication means between the NMDs 512, 514, and 516, CR 522, and PBDs 532, 534, 536, and 538 may change depending on types of communication between the devices, network conditions, and/or latency demands. For instance, communication means 546 may be used when NMD 516 is first introduced to the household with the PBDs 532, 534, 536, and 538. In one case, the NMD 516 may transmit identification information corresponding to the NMD 516 to PBD 538 via NFC, and PBD 538 may in response, transmit local area network information to NMD 516 via NFC (or some other form of communication). However, once NMD 516 has been configured within the household, communication means between NMD 516 and PBD 538 may change. For instance, NMD 516 may subsequently communicate with PBD 538 via communication path 542, the cloud network 502, and communication path 544. In another example, the NMDs and PBDs may never communicate via local communications means 546. In a further example, the NMDs and PBDs may communicate primarily via local communications means 546. Other examples are also possible.

In an illustrative example, NMDs 512, 514, and 516 may be configured to receive voice inputs to control PBDs 532, 534, 536, and 538. The available control commands may include any media playback system controls previously discussed, such as playback volume control, playback transport controls, music source selection, and grouping, among other possibilities. In one instance, NMD 512 may receive a voice input to control one or more of the PBDs 532, 534, 536, and 538. In response to receiving the voice input, NMD 512 may transmit via communication path 542, the voice input to computing device 504 for processing. In one example, the computing device 504 may convert the voice input to an equivalent text command, and parse the text command to identify a command. Computing device 504 may then subsequently transmit the text command to the computing device 506. In another example, the computing device 504 may convert the voice input to an equivalent text command, and then subsequently transmit the text command to the computing device 506. The computing device 506 may then parse the text command to identify one or more playback commands.

For instance, if the text command is "Play 'Track 1' by 'Artist 1' from 'Streaming Service 1' in 'Zone 1'," The computing device 506 may identify (i) a URL for "Track 1" by "Artist 1" available from "Streaming Service 1," and (ii) at least one playback device in "Zone 1." In this example, the URL for "Track 1" by "Artist 1" from "Streaming Service 1" may be a URL pointing to computing device 508, and "Zone 1" may be the bonded zone 530. As such, upon identifying the URL and one or both of PBDs 536 and 538, the computing device 506 may transmit via communication path 544 to one or both of PBDs 536 and 538, the identified URL for playback. One or both of PBDs 536 and 538 may responsively retrieve audio content from the computing device 508 according to the received URL, and begin playing "Track 1" by "Artist 1" from "Streaming Service 1."

One having ordinary skill in the art will appreciate that the above is just one illustrative example, and that other implementations are also possible. In one case, operations performed by one or more of the plurality of devices 500, as described above, may be performed by one or more other devices in the plurality of device 500. For instance, the conversion from voice input to the text command may be alternatively, partially, or wholly performed by another device or devices, such as NMD 512, computing device 506, PBD 536, and/or PBD 538. Analogously, the identification of the URL may be alternatively, partially, or wholly performed by another device or devices, such as NMD 512, computing device 504, PBD 536, and/or PBD 538.

f. Example Network Microphone Device

Figure 6:
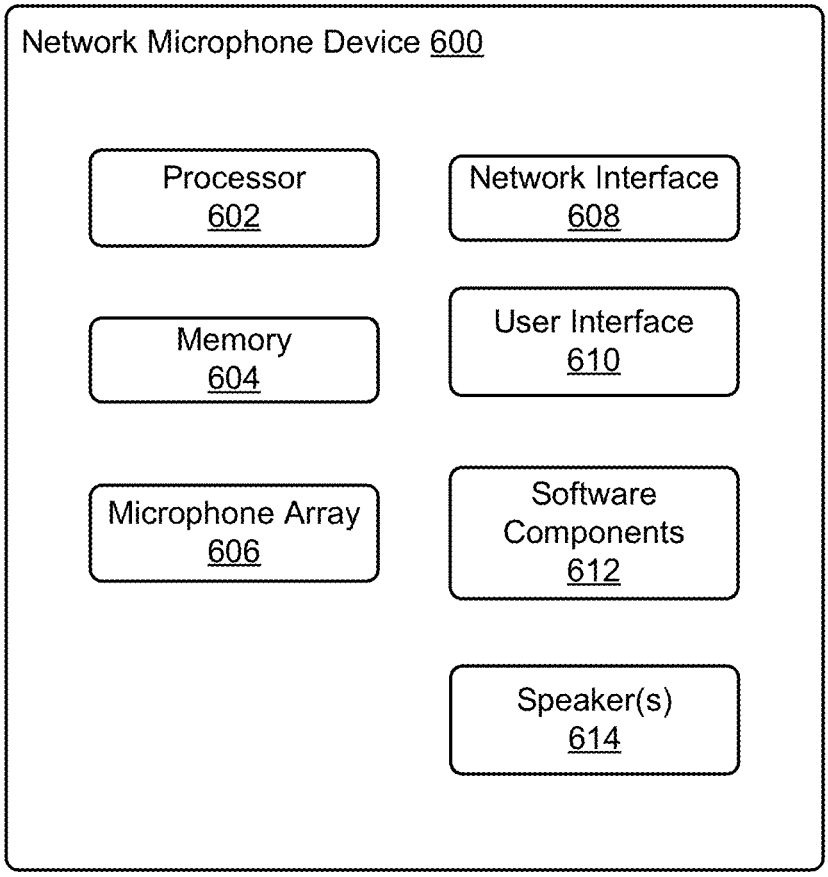
FIG. 6 shows a functional block diagram of an example network microphone device.

FIG. 6 shows a function block diagram of an example network microphone device 600 that may be configured to be one or more of NMDs 512, 514, and 516 of FIG. 5. As shown, the network microphone device 600 includes a processor 602, memory 604, a microphone array 606, a network interface 608, a user interface 610, software components 612, and speaker(s) 614. One having ordinary skill in the art will appreciate that other network microphone device configurations and arrangements are also possible. For instance, network microphone devices may alternatively exclude the speaker(s) 614 or have a single microphone instead of microphone array 606.

The processor 602 may include one or more processors and/or controllers, which may take the form of a general or special-purpose processor or controller. For instance, the processing unit 602 may include microprocessors, microcontrollers, application-specific integrated circuits, digital signal processors, and the like. The memory 604 may be data storage that can be loaded with one or more of the software components executable by the processor 602 to perform those functions. Accordingly, memory 604 may comprise one or more non-transitory computer-readable storage mediums, examples of which may include volatile storage mediums such as random access memory, registers, cache, etc. and non-volatile storage mediums such as read-only memory, a hard-disk drive, a solid-state drive, flash memory, and/or an optical-storage device, among other possibilities.

The microphone array 606 may be a plurality of microphones arranged to detect sound in the environment of the network microphone device 600. Microphone array 606 may include any type of microphone now known or later developed such as a condenser microphone, electret condenser microphone, or a dynamic microphone, among other possibilities. In one example, the microphone array may be arranged to detect audio from one or more directions relative to the network microphone device. The microphone array 606 may be sensitive to a portion of a frequency range. In one example, a first subset of the microphone array 606 may be sensitive to a first frequency range, while a second subset of the microphone array may be sensitive to a second frequency range. The microphone array 606 may further be arranged to capture location information of an audio source (e.g., voice, audible sound) and/or to assist in filtering background noise. In some embodiments the microphone array may consist of only a single microphone, rather than a plurality of microphones.

The network interface 608 may be configured to facilitate wireless and/or wired communication between various network devices, such as, in reference to FIG. 5, CR 522, PBDs 532-538, computing device 504-508 in cloud network 502, and other network microphone devices, among other possibilities. As such, network interface 608 may take any suitable form for carrying out these functions, examples of which may include an Ethernet interface, a serial bus interface (e.g., FireWire, USB 2.0, etc.), a chipset and antenna adapted to facilitate wireless communication, and/or any other interface that provides for wired and/or wireless communication. In one example, the network interface 608 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on).

The user interface 610 of the network microphone device 600 may be configured to facilitate user interactions with the network microphone device. In one example, the user interface 608 may include one or more of physical buttons, graphical interfaces provided on touch sensitive screen(s) and/or surface(s), among other possibilities, for a user to directly provide input to the network microphone device 600. The user interface 610 may further include one or more of lights and the speaker(s) 614 to provide visual and/or audio feedback to a user. In one example, the network microphone device 600 may further be configured to playback audio content via the speaker(s) 614.

III. Example Systems and Methods for Acoustic Position Measurement

As discussed above, in some examples, it may be beneficial to determine one or more calibrations for the media playback system based on the position of a speaker-equipped device relative to one or more microphone-equipped devices to improve calibration techniques and to improve a listener's audio experience. In operation, an individual microphone-equipped device may be any of the herein-disclosed components that include one or more microphones (e.g., any playback device, networked microphone device, or controller with one or more microphones) and an individual speaker-equipped device may be any of the herein-disclosed components that include one or more speakers (e.g., any playback device, networked microphone device, or controller with one or more speakers).

For example, in some embodiments, the speaker-equipped device might be a controller device, e.g., controller 522 shown and described with reference to FIG. 5, and the microphone-equipped device might be a playback device, e.g., any of PBDs 532, 534, 536, or 538, as shown an described with reference to FIG. 5. In other embodiments, the speaker-equipped device may be a first playback device, and the microphone-equipped device may be a second playback device. In still further embodiments, the speaker-equipped device may be a playback device and the microphone-equipped device may be a networked microphone device. In yet further embodiments, the speaker-equipped device may be a networked microphone device and the microphone-equipped device may be a playback device. Other arrangements of one or more playback devices, networked microphone devices, and/or controllers as the speaker-equipped and microphone-equipped devices are possible as well.

Figure 7A:
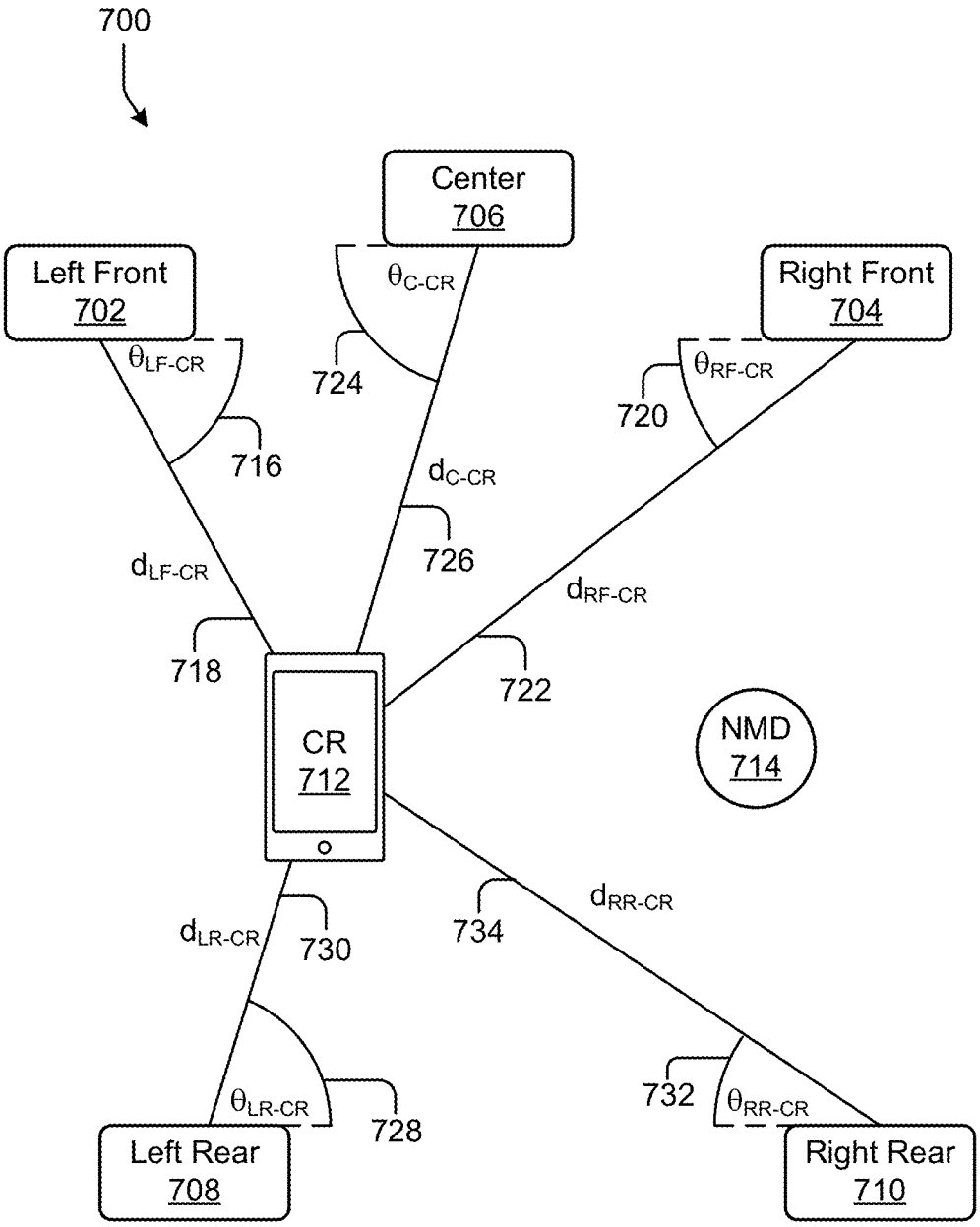
FIG. 7A shows aspects of a system and method for determining a position of a speaker-equipped device relative to a plurality of microphone-equipped devices in an example media playback system.

FIG. 7A shows aspects of a system and method for determining a position of a speaker-equipped device relative to a plurality of microphone-equipped devices in an example media playback system 700. The example media playback system 700 in FIG. 7A includes a plurality of playback devices 702-710, a controller CR 712, and a networked microphone device (NMD) 714. Embodiments may include more, fewer, or different components than the ones shown in the example media playback system 700.

The playback devices 702-710 of media playback system 700 are components of a surround sound system, where playback device 702 is or at least includes a left front speaker(s), playback device 704 is or at least includes a right front speaker(s), playback device 706 is or at least includes a center channel speaker(s), playback device 708 is or at least includes a left rear speaker(s), and playback device 710 is or at least includes a right rear speaker(s). One or more of the playback devices 702-710 may be similar to or the same as any of playback devices disclosed and described herein, e.g., playback devices 102-124 (FIG. 1), playback device 200 (FIG. 2), or PBDs 532-538 (FIG. 5). For example, in addition to having speakers for playing media content, one or more of the playback devices 702-710 may be also equipped with one or more microphones, and thus, one or more of the playback devices 702-710 may be considered either (or both) a speaker-equipped device and/or microphone-equipped device within the context of the features and functions performed by the systems and methods described herein.

The controller CR 712 may be similar to or the same as any of the controller devices disclosed and described herein, e.g., controllers 126-128 (FIG. 1), controller 300 (FIG. 3) or CR 522 (FIG. 5). In operation, CR 712 may be configured to display a user interface similar to or the same as the user interface shown and described with reference to FIG. 4. For example, in some embodiments, in addition to having a screen for displaying a user interface, the controller CR 712 may also include one or more microphones and/or one or more speakers, and thus, the controller CR 712 may be considered either (or both) a speaker-equipped device and/or a microphone-equipped device within the context of the features and functions performed by systems and methods described herein.

Likewise, NMD 714 may be similar to or the same as any of the networked microphone devices disclosed and described herein, e.g., NMDs 512-514 (FIG. 5) or networked microphone device 600 (FIG. 6). For example, NMD 714 may include one or more microphones and/or one or more speakers, and thus, the NMD 714 may be considered either (or both) a speaker-equipped device or microphone-equipped device within the context of the features and functions performed by the systems and methods described herein.

In some embodiments, to determine a position of a speaker-equipped device relative to a plurality of microphone-equipped devices, the media playback system 700 (or at least one component of the media playback system 700) first determines that position information of a speaker-equipped device is required, or at least desired. In the example shown in FIG. 7A, the controller CR 712 is a speaker-equipped device and the playback devices 702-710 (or at least one of the playback devices 702-710) are microphone-equipped devices. Thus, in this example, determining a requirement for position information of the speaker-equipped device amounts to determining the position of the controller CR 712 relative to at least one of the playback devices 702-710.

In operation, the determination that position information for CR 712 is required (or at least desired) can be made in response to one or more commands to perform a function for which position information for controller CR 712 is required, or at least desired. For example, in some embodiments, determining a requirement for position information of the speaker-equipped device comprises receiving a command to configure surround sound processing parameters of the media playback system 700 based on a position of the controller CR 712. In response to receiving such a command, the media playback system 700 (or at least one or more components thereof) determines that position information of the controller CR 712 is required, or at least desired.

In another example, determining a requirement for position information of the speaker-equipped device in the media playback system comprises receiving a command for a first playback device to form a stereo pair with a second playback device of the media playback system. For example, controller CR 712 may receive a command to form a stereo pair with left front 702 and right front 704 playback devices. Upon receiving such a command, the media playback system 700 (or at least one or more components thereof) may determine that position information of the controller CR 712 is required.

After determining a requirement for position information of a speaker-equipped device within a room in which a media playback system is located, or perhaps in response to determining a requirement for position information of a speaker-equipped device within a room in which a media playback system is located, the media playback system 700 (or least one or more components thereof) determines a position of the speaker-equipped device relative to at least one microphone-equipped device of the media playback system based at least in part on one or more test sounds emitted from the speaker-equipped device.

Some embodiments may also include messaging between the speaker-equipped device and the one or more microphone-equipped device(s) before the speaker-equipped device begins emitting the test sound(s), and/or perhaps while the speaker-equipped device emits the test sound(s). For example, in some embodiments, the speaker-equipped device sends one or more control messages to one or more microphone-equipped devices in the media playback system 700 to (i) inform the microphone-equipped devices that the speaker-equipped device is about to begin emitting test sound(s) for spatial measurements and/or (ii) command the one or more microphone-equipped devices to listen for the test sound(s) for the purpose of conducting a spatial measurement. Alternatively, one or more microphone-equipped devices of the media playback system 700 sends one or more control messages to the speaker-equipped device to (i) inform the speaker-equipped device that a spatial measurement is required, and/or (ii) command the speaker-equipped device to emit test sound(s) for the purpose of conducting the spatial measurement.

In some embodiments, the one or more control messages exchanged between the speaker-equipped device and the one or more microphone-equipped device(s) may further include a presentation timestamp to indicate a time when the speaker-equipped device will play (or has already played) the test sound(s) for detection by the one or more microphone-equipped devices. In such embodiments, the media playback system 700 (or one or more devices thereof) uses the presentation timestamp to perform time delay calculations associated with determining, for an individual microphone-equipped device, the angle to and distance from the speaker-equipped device.

Some embodiments may further include the speaker-equipped device(s) and/or the microphone-equipped device(s) indicating to a user that a spatial measurement is about to begin and/or is in progress. The indication may be an audible indication (e.g., a notification played via a speaker on the speaker-equipped device(s) and/or the microphone-equipped device(s)) or a visible indication (e.g., a flashing and/or colored light on the speaker-equipped device(s) and/or the microphone-equipped device(s)), an indication within a user interface application running on a controller).

In operation, the device to be located (e.g., the speaker-equipped device) plays the test sounds(s) during the location determination procedure. The test sound(s) may be in the audible or inaudible frequency range. However, the frequency or frequencies used for the test sound should be within a frequency range capable of reproduction by one or more speakers of the speaker-equipped device(s) and a frequency range capable of detection by one or more microphones of the microphone-equipped device(s). For embodiments where more than one speaker-equipped device is to be detected at the same or substantially the same time, then the test sounds emitted by each speaker-equipped device should be different in frequency and/or time, e.g., pulsating tones, different pulsing rates, tones played at different times, and so on, so that the microphone-equipped device(s) can distinguish between the test sounds emitted by the different speaker-equipped devices. In some embodiments, the test sound may comprise music or other media played by one or more of the speaker-equipped devices.

The test sound(s) emitted from the speaker-equipped device may take the form of, for example, a test signal, sound, test tone (e.g., ultrasonic tone), pulse, rhythm, frequency or frequencies, or audio pattern. The frequency range may include a range of frequencies that the playback device is capable of emitting (e.g., 15-30,000 Hz) and may be inclusive of frequencies that are considered to be in the range of human hearing (e.g., 20-20,000 Hz). The pulse may be a recording of a brief audio pulse that approximates an audio impulse signal. Some examples include recordings of an electric spark, a starter pistol shot, or the bursting of a balloon. In some examples, the audio signal may include a signal that varies over frequency, such as a logarithmic chirp, a sine sweep, a pink noise signal, or a maximum length sequence. Such signals may be chosen for relatively broader-range coverage of the frequency spectrum or for other reasons. The test sound may involve other types of audio signals as well.

In some embodiments, the test sound may have a particular waveform. For instance, the waveform may correspond to any of the example test sounds described above, such as, an electric spark, a starter pistol shot, or the bursting of a balloon. The speaker-equipped device may store the first audio signal as a recording and play it back during the position determination procedure. The recording may take a variety of audio file formats, such as a waveform audio file format (WAV) or an MPEG-2 audio layer III (MP3), among other examples. Alternatively, the speaker-equipped device may dynamically generate the audio signal. For instance, the speaker-equipped device may generate a signal that varies over frequency according to a mathematical equation. Other examples are possible as well.

In operation, the microphone-equipped device should know the test sound(s) that the speaker-equipped device will use for the position determination process. In some embodiments, the speaker-equipped device sends a data file comprising the test sound(s) to the microphone-equipped device(s) so that the microphone-equipped devices will know the test sound(s) they are listening for. Alternatively, some embodiments include one or more of the microphone-equipped devices sending a data file comprising the test sound(s) to the speaker-equipped device. And after receiving the data file comprising the test sound(s), the speaker-equipped device plays the test sound(s).

In some embodiments, both the speaker-equipped device and the microphone-equipped device(s) receive the test sound(s) that will be used for the position determination from another computing device, e.g., one or more of computing devices 504-508 (FIG. 5). Alternatively, the speaker-equipped device and the microphone-equipped device(s) can each obtain the test sound(s) from a network location via a uniform resource identifier (URI), uniform resource locator (URL), and/or an index or path for a file stored at a location accessible by at least one of the speaker-equipped device and/or the microphone-equipped device(s).

In still further embodiments, the speaker-equipped device and the microphone-equipped device(s) may receive a set of test sound parameters for a tone generator (e.g., a software-based tone generator) located on at least the speaker-equipped device and possibly also the microphone-equipped device(s). After receiving the parameters for the tone generator, the speaker-equipped device then uses the received parameters to generate the test sound(s).

In some embodiments, the speaker-equipped device sends a data file comprising the test sound parameters to the microphone-equipped device(s) so that the microphone-equipped device(s) will know the test sound(s) that the speaker-equipped device will generate. Alternatively, some embodiments include one or more of the microphone-equipped devices sending a data file comprising the test sound parameters to the speaker-equipped device. And after receiving the data file comprising the test sound parameters, the speaker-equipped device configures the tone generator with the test sound parameters, generates the test sound(s), and plays the test sound(s) via one or more speakers.

In some embodiments, both the speaker-equipped device and the microphone-equipped device(s) receive test sound parameters that will be used by a tone generator at the speaker-equipped device for the position determination from another computing device, e.g., one or more of computing devices 504-508 (FIG. 5). Alternatively, the speaker-equipped device and the microphone-equipped device(s) can each obtain the test sound parameters from a network location via a uniform resource identifier (URI), uniform resource locator (URL), and/or an index or path for a file stored at a location accessible by at least one of the speaker-equipped device and/or the microphone-equipped device(s).

Once the speaker-equipped device has the test sound(s) and/or test sound parameters, the speaker-equipped device then plays the test sound(s) and the microphone-equipped device(s) detect the test sound(s) emitted from the speaker-equipped device. With reference to FIG. 7A, for example, if the speaker-equipped device is the controller CR 712 and the microphone-equipped device is the left front 702 playback device, then the controller CR 712 (i.e., a speaker-equipped device) plays the test sound(s) and one or more of the playback devices 702-710 (i.e., microphone-equipped devices) detect the test sound(s) emitted from the speaker-equipped device.

In some embodiments, the microphone-equipped device(s) may also analyze the detected test sound(s) emitted from the speaker-equipped device to determine the position of the speaker-equipped device, but in other embodiments, the microphone-equipped device(s) may alternatively send the captured test sound(s) to one or more computing devices for analysis, e.g., computing devices 504-508 (FIG. 5), or even the controller CR 712.

In some embodiments, determining a position of the speaker-equipped device relative to a microphone-equipped device of the media playback system based at least in part on the test sound(s) emitted from the speaker-equipped device comprises determining (i) an angle of the speaker-equipped device relative to the microphone-equipped device and (ii) a distance between the speaker-equipped device and the microphone-equipped device. In some embodiments, the media playback system 700 may determine the position of a speaker-equipped device relative to a microphone-equipped device while the media playback device is playing media. Alternatively, the media playback system 700 may stop playing media while determining the position of the speaker-equipped device relative to the microphone-equipped device to prevent (or at least reduce) acoustic interference with the position measurement.

In the example shown in FIG. 7A, the left front 702 playback device determines the position of controller CR 712 based at least in part on a test sound(s) emitted from the controller CR 712 by determining (i) the angle 716 of the controller CR 712 relative to the left front 702 playback device and (ii) the distance 718 between the controller CR 712 and the left front 702 playback device.

In some embodiments, each of the other playback devices 706-710 may also determine its own relative angle to and distance from the controller CR 712 based at least in part on the test sound(s) emitted from the controller CR 712. For example, center 706 may determine angle 724 to and distance 726 from controller CR 712; right front 704 may determine angle 720 to and distance 722 from controller CR 712; left rear 708 may determine angle 728 to and distance 730 from controller CR 712; and right rear 710 may determine angle 732 to and distance 734 from controller CR 712. Alternatively, each playback device may record the test sound emitted by the controller CR 712 and send the recorded sound to one or more computing devices for analysis, e.g., computing devices 504-508 (FIG. 5), or even the controller CR 712.

In some embodiments, one of the playback devices (e.g., left front 702) is configured as a master playback device for the media playback system 700, and each of the other playback devices (e.g., 704-710) are configured as slave playback devices. In some embodiments with master and slave playback devices, the master (e.g., 702) may determine the angle (e.g., 716) to and distance (e.g., 718) from the controller CR 712, and each of the slave playback devices (e.g., 704-710) may send a recording of the sound emitted by the controller CR 712 to the master playback device (e.g., 702) for analysis and determination of the relative angles (e.g., 720, 724, 728, and 732) and distances (e.g., 722, 726, 730, and 732) between the slave playback devices and the controller CR 712.

In some embodiments, each microphone-equipped device has a microphone array comprising two or more microphones, and the microphone-equipped device uses the test sound(s) detected by the microphone array to determine the angle to and distance from a speaker-equipped device. In operation, each of the microphone-equipped device(s) knows the position of each microphone in its microphone array relative to the "front" and/or "center" of the microphone-equipped device. For example, if the left front 702 playback device has a microphone array comprising at least two microphones, the program code for determining the position of the speaker-equipped device relative to the left front 702 playback device includes information about the position of the microphones of the microphone array of the left front 702 playback device, e.g., where those microphones are located on the left front 702 playback device relative to the front and/or center of the left front 702 playback device.

In embodiments where individual microphone-equipped devices have only a single microphone, then the single microphone on each of the two microphone-equipped devices can be used as a microphone array for determining the position of the speaker-equipped device relative to a virtual line connecting the two microphone-equipped devices. For example, with reference to FIG. 7A, if the controller CR 712 is the speaker-equipped device and left front 702 and right front 704 playback devices each have only a single microphone, then the left front 702 and right front 704 playback devices can perform synchronized detection of the test sound(s) emitted by the controller CR 712. In some embodiments, the media playback system 700 (or one or more components thereof) determine the distance of the virtual line between the left front 702 playback device and the right front 704 playback device according to the methods described herein with reference to Equation 2, explained in more detail below.

Based on the test sound(s) emitted by the controller CR 712 and detected by the microphones of the left front 702 and right front 704 playback devices, the media playback system 700 (or one or more components thereof) can determine the position of the controller CR 712 relative to the center of a virtual line joining the left front 702 and left right 704 playback devices. And if the position of the left front 702 playback device relative to the right front 704 playback device is known (or vice versa), then the media playback system 700 (or one or more components thereof) can use both (i) the position of the left front 702 and right front 704 playback devices relative to each other and (ii) the position of the controller CR 712 relative to the center of the virtual line joining the left front 702 and right front 704 playback devices to determine the angle to and distance from the controller CR 712 for both the left front 702 and right front 704 playback devices.

In embodiments where individual microphones on two or more microphone-equipped devices are used as a microphone array for determining the position of a speaker-equipped device relative to one or more microphone-equipped devices, each of the microphone-equipped device(s) whose individual microphones comprise the microphone array knows the position of its microphone relative to the "front" and/or "center" of the microphone-equipped device. For example, if the left front 702 playback device has a single microphone, the program code for determining the position of the speaker-equipped device relative to the left front 702 playback device includes information about the position of the microphone of the left front 702 playback device, e.g., where the microphone is located on the left front 702 playback device relative to the front and/or center of the left front 702 playback device. Similarly, if the right front 704 playback device has a single microphone, the program code for determining the position of the speaker-equipped device relative to the right front 704 playback device includes information about the position of the microphone of the right front 704 playback device, e.g., where the microphone is located on the right front 704 playback device relative to the front and/or center of the right front 704 playback device.

Further, in embodiments where individual microphones on two or more microphone-equipped devices are used as a microphone array for determining the position of a speaker-equipped device relative to one or more microphone-equipped devices, device clocks of each of the microphone-equipped devices whose individual microphones comprise the microphone array ideally are synchronized (preferably to within a single sample accuracy) to improve the accuracy of the position measurements. But in some embodiments, if both microphone-equipped devices are playback devices that are configured play back audio in synchrony with each other, each playback device can rely upon timing information derived from their synchronous playback protocol rather than timing information derived from synchronized device clocks.

In some embodiments, determining the angle of the speaker-equipped device relative to the microphone-equipped device comprises solving for Equation 1:

$$\theta = \cos^{-1}\left(\frac{t_d * v_s}{|d_{mm}|}\right) \qquad \text{Equaiton 1}$$

In Equation 1, θ is the angle of the speaker-equipped device relative to the microphone-equipped device, $t_d$ is a measurement of delay between when a test sound is detected by a first microphone of the microphone-equipped device and when the test sound is detected by a second microphone of the microphone-equipped device, $v_s$ is a speed of sound constant, and $d_{mm}$ is the distance between the first and second microphones of the microphone-equipped device. Thus, in the example shown in FIG. 7A, determining the angle 716 of the controller CR 712 relative to the left front 702 playback device includes solving for Equation 1, where θ is the angle 716 of the controller CR 712 relative to the left front 702 playback device, $t_d$ is a measurement of delay between when a test sound emitted from the controller CR 712 is detected by a first microphone of the left front 702 playback device and when the test sound emitted from the controller CR 712 is detected by a second microphone of the left front 702 playback device, $v_s$ is a speed of sound constant, and $d_{mm}$ is the distance between the first and second microphones of the left front 702 playback device.

To determine the delay between when a test sound is detected by a first microphone and when the test sound is detected by a second microphone (regardless of whether the first and second microphones are components of a microphone array on a single microphone-equipped device or components of a microphone array formed from individual microphones on two separate microphone-equipped devices, as described above), the media playback system 700 (or one or more components thereof) determines the difference between (i) when the first microphone detected the test sound(s) and (ii) when the second microphone detected the test sound(s). A microphone-equipped device can determine when a particular microphone detects a test sound via a number of methods.

For example, in some embodiments, a microphone-equipped device can determine when a particular microphone (e.g., the first or second microphone) detects a test sound based on sound pressure level, by quantifying a point in time where sound pressure level corresponding to the test sound increases above some threshold level. In other embodiments, a microphone-equipped device, individually or in combination with other computing devices, may additionally or alternatively apply a Fast Fourier Transform (FFT) and/or an Inverse Fast Fourier Transform (IFFT) on a received sound signal to determine a time (e.g., with reference to a device clock) when a particular microphone detects a test sound. For instance, controller CR 522 may emit one or more test sounds, and the microphone-equipped devices (or any other device described herein) may analyze the frequency, amplitude, and phase of the one or more test sounds. In other instances, the microphone-equipped devices may analyze a frequency and/or time domain representation of the detected test sound in order to determine the start of when CR 522 emits the one or more test sounds. Other examples to determine the start of when CR 522 emits the one or more tests sounds are possible. If the speaker-equipped device emits a plurality of test sounds for the position determination, then the signals detected by each microphone can be analyzed to determine when (e.g., to within a particular device clock sample time) the test sound first appeared in each signal detected by each microphone of the microphone array.

In some embodiments, determining the distance between the speaker-equipped device and the microphone-equipped device comprises solving for Equation 2:

$$d = v_s * (\text{transmission delay}) \qquad \text{Equation 2:}$$

In Equation 2, d is the distance between the speaker-equipped device and the microphone-equipped device, $v_s$ is a speed of sound constant, and transmission delay is a measurement of delay between when a test sound is detected by the microphone-equipped device and when the test sound was played by the speaker-equipped device. Thus, in the example shown in FIG. 7A, determining the distance 718 between the controller CR 712 and the left front 702 playback device includes solving for Equation 2, where d is the distance 718 between the controller CR 712 and the left front 702 playback device, $v_s$ is a speed of sound constant, and transmission delay is a measurement of delay between (i) the time that a test sound emitted by the controller CR 712 is detected by the left front 702 playback device and (ii) the time the test sound was emitted by the controller CR 712.

In some embodiments, it is advantageous to synchronize device clocks of the speaker-equipped device and the microphone-equipped device to within a single-sample accuracy (or perhaps even better than single-sample accuracy) to improve the precision of the angle and/or distance determinations. For example, in some embodiments, the device clock of the controller CR 712 may be synchronized with the device clock of the front left 702 playback device to within a single-sample accuracy to improve the precision of (i) the $t_d$ measurement of Equation 1 and (ii) the transmission delay measurement of Equation 2.

However, in some embodiments, synchronization of device clocks between the speaker-equipped device and the microphone-equipped device may not be necessary. For example, if the speaker-equipped device and the microphone-equipped device are both playback devices in the media playback system 700 configured for synchronous media playback, the speaker-equipped device and the microphone-equipped device may rely upon timing information derived from their synchronous playback protocol to obtain an accurate measurement for $t_d$ in Equation 1 and transmission delay in Equation 2, even though the microphone-equipped device and speaker-equipped device in such embodiments are, or at least may be, independently clocked.

As mentioned above, in some embodiments, the speaker-equipped device and the one or more microphone-equipped devices exchange one or more control messages that include a presentation timestamp to indicate a time when the speaker-equipped device will play (or has already played) the test sound(s) for detection by the one or more microphone-equipped devices. In some embodiments, the speaker-equipped device plays the test sound(s) at the time indicated in the presentation timestamp. A microphone-equipped device detects the start of the test sound at a microphone of the microphone-equipped device according to any of the methods for detecting the start of a test sound described above. The microphone-equipped device (individually or perhaps in combination with one or more other computing devices) can then calculate the distance between the microphone-equipped device and an individual speaker-equipped device by (i) subtracting the presentation time-stamp from the detection time, thereby yielding a transmission delay and (ii) calculating the distance from speaker-equipped device to the microphone-equipped device by multiplying the calculated transmission delay by the value of the speed of sound constant, $v_s$.

After determining the position of the speaker-equipped device relative to the one or more microphone-equipped devices (e.g., based on the angle and distance calculations described above, or perhaps via alternative methods), some embodiments further include configuring one or more audio configuration parameters of the media playback system 700 based on the position of the speaker-equipped device relative to the one or more microphone-equipped devices. For example, after front left 702 playback device determines the position of the controller CR 712 relative to front left 702 playback device, the front left 702 playback device may configure one or more sound processing parameters of the front left 702 playback device and perhaps other playback devices of the media playback system 700.

In operation, some of the parameters that may be configured based on the determined angles and distances include equalization, surround sound parameters, and/or stereo parameters.

In one example, an application running on the controller CR 712 instructs a user to stand or sit in a preferred location where he or she typically watches movies, television, or other content with surround sound encoded media. When the user is standing or sitting at the preferred location in the room, the media playback system 700 performs the above-described procedure to determine the position of the controller CR 712 relative to one or more of the playback devices 702-710. The media playback system 700 may then use the position information of the controller CR 712 at the preferred location to configure one or more audio configuration parameters the playback devices 702-710 so that the "acoustic center" of the media played by the playback devices 702-710 is aligned with the preferred location.

In this context, the "acoustic center" means the location where the surround sound effect is focused, such that a user at that position will (or at least should) hear the optimal (or at least a very good) separation between the different surround sound channels. For example, for five channel encoded surround sound media, the "acoustic center" is the location where the user should hear very good (perhaps even optimal) separation between the five channels, i.e., left front, center, right front, left rear, and right rear. Thus, in operation, configuring one or more audio configuration parameters of the media playback system 700 based on the position of the speaker-equipped device (e.g., controller CR 712) relative to the microphone-equipped device(s) comprises configuring one or more of a volume and/or delay processing parameter for one or more speakers of one or more of the playback devices 702-710 in media playback system 700 such that the "acoustic center" of surround sound media played by the media playback system 700 is aligned with the position of the controller CR 712 when the media playback system 700 determined the position of the controller CR 712.

In another example, an application running on the controller CR 712 instructs a user to stand or sit in a preferred location where he or she typically listens to standard two-channel stereo music. When the user is standing or sitting at the preferred location in the room, the media playback system 700 performs the above-described procedure to determine the position of the controller CR 712 relative to the left front 702 playback device and the right front 704 playback device. The media playback system 700 may then use the position information of the controller CR 712 at the preferred location to configure one or more audio configuration parameters of the left front 702 and right front 704 playback devices so that the "acoustic center" of stereo music played by the media playback system 700 is aligned with the preferred location.

In this context, the "acoustic center" means the location where the stereo sound effect is focused, such that a user at that position will (or at least should) hear the optimal (or at least a very good) separation between the stereo channels. For example, for standard two-channel channel encoded stereo media, the "acoustic center" is the location where the user should hear very good (perhaps even optimal) separation between left and right channels. Thus, in operation, configuring one or more audio configuration parameters of the media playback system 700 based on the position of the speaker-equipped device (e.g., controller CR 712) relative to the left front 702 and right front 704 playback devices comprises configuring one or more of a volume and/or delay processing parameter for one or more speakers of the left front 702 and right front 704 playback devices. In some embodiments, the left front 702 and left rear 708 playback devices may be bonded together and configured to play left channel stereo content and the right front 704 and right rear 710 may be bonded together to play right channel stereo content.

Similarly, for four-channel quadraphonic stereo media, the "acoustic center" is the location where the user should hear very good (perhaps even optimal) separation between the four quadraphonic stereo channels, e.g., left front, right front, left rear, right rear, or perhaps other quadraphonic channels. Thus, in operation, configuring one or more audio configuration parameters of the media playback system 700 based on the position of the speaker-equipped device (e.g., controller CR 712) relative to the left front 702, right front 704, left rear 708, and right rear 710 playback devices comprises configuring one or more of a volume and/or delay processing parameter for one or more speakers of the left front 702, right front 704, left rear 78, and right rear 710 playback devices.

In some embodiments, the preferred location associated with the above-described surround sound configuration may be different than the preferred location associated with the above-described stereo configuration. But in some embodiments, the preferred location for surround sound and stereo might be the same, and in such embodiments, the media playback system 700 may use the same preferred location for configuring the audio configuration parameters for both surround sound and stereo operation.

Additionally, position information for the speaker-equipped device may also be used with spectral calibration procedures for measuring or otherwise characterizing the frequency response of a room in which the media playback system 700 is operating. Measuring or otherwise characterizing the frequency response of a room may be helpful in identifying which frequencies the room tends to attenuate and which frequencies the room tends to amplify or accentuate. Once the frequency response of the room is known, equalization and/or other audio playback parameters for one or more playback devices 702-710 of the media playback system 700 can be adjusted to compensate for the frequencies that the room tends to attenuate or amplify in order to improve the listening experience. In some embodiments, the spectral calibration procedure may be the Sonos Trueplay calibration procedure. But other spectral calibration procedures could be used instead.

In some embodiments, the media playback system 700 (or at least one or more components thereof) first determines a requirement (or at least a desire) for position information of one or more speaker-equipped devices in connection with a spectral calibration procedure. In such embodiments, determining a requirement for position information of the speaker-equipped device in the media playback system comprises receiving a command to initiate a spatial calibration procedure for the media playback system, wherein the spatial calibration procedure comprises the first playback device playing one or more audio calibration tones. In some embodiments, multiple (or even all) of the playback devices 702-710 may play the one or more audio calibration tones. In some embodiments, each playback device might play the same audio calibration tones. In other embodiments, each playback device might play different audio calibration tones.

In operation, the media playback system 700 (or at least one or more playback devices 702-710 therein) tracks the position of the controller CR 712 during the Trueplay procedure (or other spectral calibration procedure). Tracking the position of the controller CR 712 during the Trueplay or other spectral calibration procedure may be helpful for instructing a user where to move the controller CR 712 during the procedure to help improve the diversity of acoustic measurements obtained during the Trueplay or other spectral calibration procedure, so as to obtain measurements from a sufficiently representative sample of locations throughout the room where the media playback system 700 is operating.

In operation, one or more of the playback devices 702-710 of the media playback system 700 plays a set of spectral calibration tones (e.g., Trueplay calibration tones) while the controller CR 712 both (i) records the set of spectral calibration tones played by the one or more playback devices 702-710 and (ii) emits a test sound (i.e., one or more spatial calibration tones) that is different than the set of spectral calibration tones emitted by the playback devices 702-710. While one or more of the playback devices 702-710 are playing the set of spectral calibration tones, one or more of the playback devices 702-710 are also determining the position of the controller CR 712 relative to one or more of the playback devices 702-710 based at least in part on the spatial calibration tone(s) emitted by the controller CR 712.

In some embodiments, determining the position of the controller CR 712 relative to one or more of the playback devices 702-710 based on the test sound(s) (sometimes referred to herein as spatial calibration tone(s)) during the spectral calibration procedure includes determining (i) an angle of the controller CR 712 (i.e., a speaker-equipped device) relative to one or more of the playback devices 702-710 (i.e., microphone-equipped devices) and (ii) a distance between the controller CR 712 and one or more of the playback devices 702-710. In operation, determining the angle(s) and distance(s) during the spectral calibration procedure may be performed in the same or substantially the same manner as described above with reference to Equations 1 and 2.

By determining the angle and position of the controller CR 712 multiple times (e.g., one or more times per second) for some period of time (e.g., up to a minute or perhaps longer), the media playback system 700 can track the position of the controller CR 712 during the spectral calibration procedure. As mentioned previously, tracking the position of the controller CR 712 during the spectral calibration procedure enables the media playback system 700 (or one or more components thereof) to measure the spectral response of the room at different locations in the room where the media playback device 700 is operating, thereby determining a spectral response as a function of position throughout the room where the media playback system 700 is operating.

In some embodiments, the media playback system 700 may use the position information obtained during the spectral calibration procedure to determine whether the controller device CR 712 has obtained sound measurements from a sufficiently diverse set of locations throughout the room. In some embodiments, an application running on the controller device CR 712 may instruct the user to move to particular location within the room, and once in that particular location, indicate to the application when the user is at the particular location.

For example, the application may instruct the user to move to the right rear corner of the listening area, and once there, select and/or activate a corresponding icon displayed on the screen of the controller CR 712 running the application. After indicating the right rear corner of the room, the application may then instruct the user to walk along the rear of the room to the left rear corner of the room, and once in the left rear corner, select and/or activate a corresponding icon displayed on the screen of the controller CR 712 running the application. The application may instruct the user to move to other locations throughout the room and indicate those locations via the application in a similar fashion.

In operation, the media playback system 700 (via at least one or more microphone-equipped devices thereof), can track the movement of the controller CR 712 (or any other speaker-equipped device) as the user moves the controller CR 712 through the room from location to location, thereby enabling the media playback system 700 to obtain a reasonably good spectral mapping of the room as a function of position. In some embodiments, the media playback system 700 may then use the spectral mapping to configure one or more audio configuration parameters of one or more of the playback devices 702-710 (or at least one or more amplifiers, equalizers, and/or speaker drivers thereof) based on the spectral response measurements.

In some embodiments, a "preferred" location for listening to surround sound or stereo media can be selected from the set of positions determined while the media playback system 700 is tracking the movement of the controller CR 712 through the room. Additionally or alternatively, the application may instruct the user to move to one or more "preferred" position(s) for listening to surround sound and/or stereo media, and then use the frequency response of the room (as determined by the spectral calibration procedure) to (i) configure equalization, volume, gain, balance, fading, and/or delay processing of one or more amplifiers and/or speakers of one or more playback devices 702-710 of the media playback system 700 based on those particular "preferred" locations (similar to manner described above) and/or (ii) tune the equalization of one or more amplifiers and/or speakers of one or more playback devices 702-710 of the media playback system 700 to compensate for the frequencies that the room tends to accentuate or attenuate at those particular "preferred" locations.

Figure 7B:
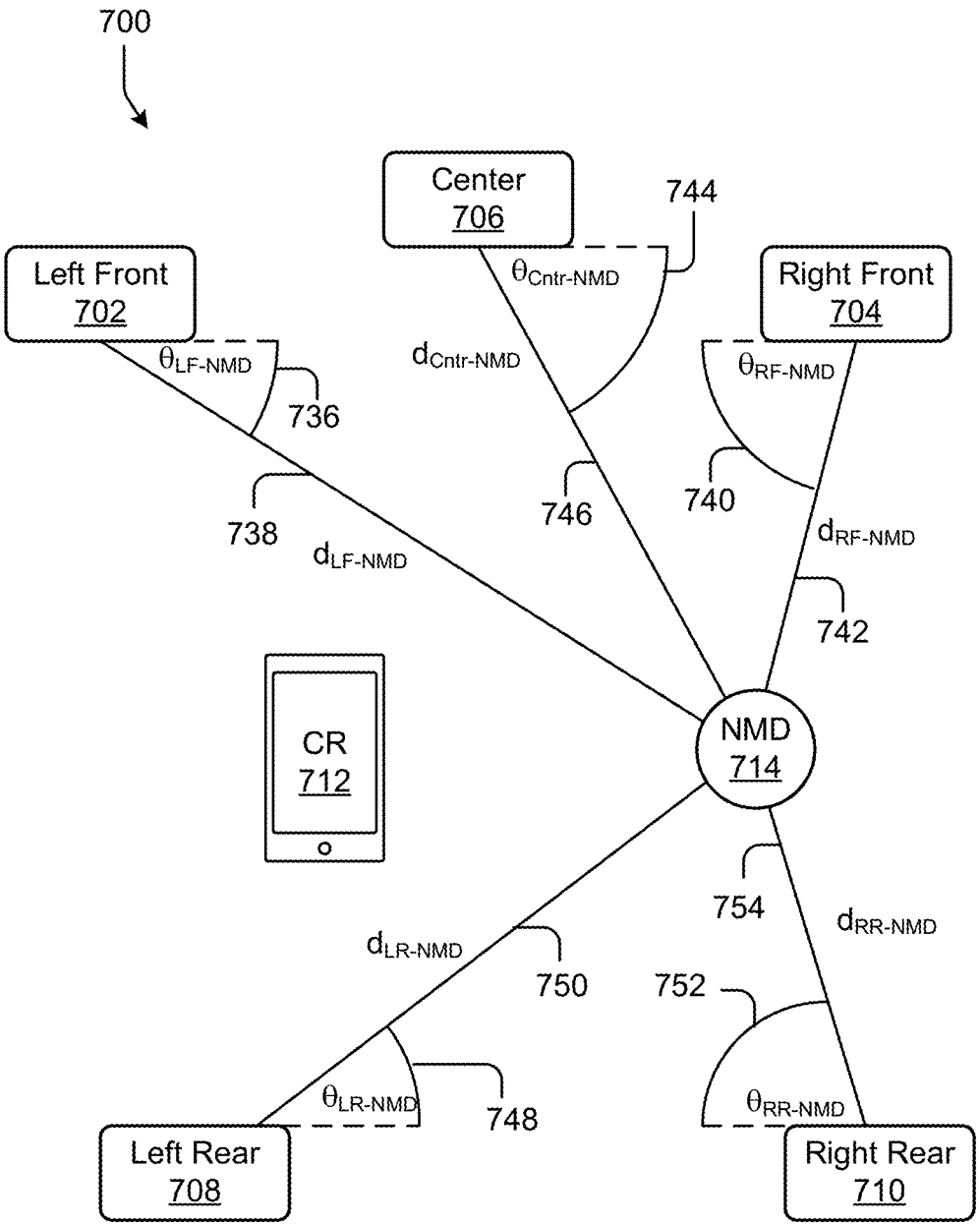
FIG. 7B shows another example illustration of determining a position of a speaker-equipped device relative to a microphone-equipped device of a media playback system based at least in part on a test sound(s) emitted from the speaker-equipped device.

FIG. 7B shows another example illustration of determining a position of a speaker-equipped device relative to a microphone-equipped device of a media playback system based at least in part on one or more test sounds emitted from the speaker-equipped device. In FIG. 7B, the speaker-equipped device is the networked microphone device (NMD) 714 and the microphone-equipped devices are one or more of the playback devices 702-710.

In embodiments where the NMD 714 is configured to receive voice commands for controlling the media playback system 700 (and/or perhaps other systems), it may be advantageous to use the position of the NMD 714 relative to the position(s) of the one or more playback devices 702-710 in the media playback system 700 to configure beam forming parameters of a microphone array of the NMD 714 to attenuate sound originating from the playback devices 702-710, thus improving the NMD's 714 ability to distinguish voice commands from music or other media played by the playback devices 702-710. The media playback system 700 can also use the position of the NMD 714 relative to the position(s) of the one or more playback devices 702-710 in the media playback system 700 to configure Acoustic Echo Cancellation (AEC) parameters of the NMS 714 based at least in part on the positions of the playback devices 702-710.

In such embodiments, determining a requirement for position information of the speaker-equipped device in the media playback system comprises receiving a command to configure a networked microphone device based at least in part on a location of one or more playback devices relative to the networked microphone device. For example, the command could be a command received via controller CR 712 to configure a networked microphone device (NMD), such as NMD 714. In some embodiments, the command could include a command to configure a beamforming microphone array of NMD 714 based at least in part on a location of one or more playback devices 702-710 relative to NMD 714.

In operation, determining the position of the NMD 714 can be performed in the same manner (or substantially the same manner) as determining the position of the controller CR 712 described above with reference to Equations 1 and 2. For example, the NMD 714 emits a test sound(s), and each of the one or more playback devices 702-710 determine the position of the NMD 714 in the same way that the one or more playback devices 702-710 determined the position of the controller CR 712 described above with reference to FIG. 7A.

For instance, NMD 714 emits one or more test sounds, and the left front 702 playback device determines the position of NMD 714 based at least in part on the test sound(s) emitted from the NMD 714 by determining (i) the angle 736 of the NMD 714 relative to the left front 702 playback device and (ii) the distance 738 between the NMD 714 and the left front 702 playback device. In some embodiments, left front 702 playback device determines the angle 736 and distance 738 according to Equations 1 and 2, respectively, as described above.

In some embodiments, each of the other playback devices 706-710 may also determine its own relative angle to and distance from the NMD 714 based at least in part on the test sound emitted from the NMD 714. For example, center 706 playback device may determine angle 744 to and distance 746 from NMD 714; right front 704 playback device may determine angle 740 to and distance 742 from NMD 714; left rear 708 playback device may determine angle 748 to and distance 750 from NMD 714; and right rear 710 playback device may determine angle 752 to and distance 754 from NMD 714. Alternatively, each playback device may record the test sound emitted by the NMD 714 and send the recorded sound to one or more computing devices for analysis, e.g., computing devices 504-508 (FIG. 5), or even the controller CR 712 or NMD 714.

Alternatively, in some embodiments, one or more of the playback devices 702-710 function as the speaker-equipped device and the NMD 714 functions as the microphone-equipped device. In such embodiments, an individual playback device (e.g., front left 702) plays a test sound, and the NMD 714 determines a position of the playback device relative to the NMD 714 based at least in part on a test sound(s) emitted from the playback device in the same manner in which the one or playback devices 702-710 determine the angle(s) to and distance(s) from the controller CR 712 described above with reference to Equations 1 and 2.

In some embodiments, the individual playback devices 702-710 each play the same test sound(s), but just at different times, so that NMD 714 can determine the angle to and distance from each playback device one by one in a serial fashion. In other embodiments, each of the playback devices 702-710 play a different test sound (e.g., at a different frequency and/or with a different pulse rate), so that NMD 714 can determine the angle(s) to and distance(s) from each playback device at the same time (or at least at substantially the same time). It will be understood that any method of distinguishing the test sound(s) emitted from the playback devices 702-710 could be used, including but not limited to one or more of (i) each playback device playing its test sound at a different time, (ii) each playback device playing a different test sound (e.g., a different frequency), (iii) each playback device encoding an identifier into its test sound, (iv) each playback device emitting its test sound with a unique timing pattern, and/or (v) any other mechanism for distinguishing signals now known or later developed.

As mentioned above, once the position of NMD 714 relative to the playback devices 702-710 is known (or vice versa), the media playback system 700 (or one or more components thereof) can use the position information to configure beamforming parameters of a microphone array of the NMD 714 to attenuate sound originating from the directions of the individual playback devices 702-710 and/or configure other parameters of the beamforming microphone array of the NMD 714.

It may also be advantageous in some instances to configure the beamforming parameters of NMD 714 to amplify sound originating from one of the "preferred" positions determined as described above with reference to FIG. 7A. But if the "preferred" positions are not known, then the NMD 714 can determine the position of the CR 712 at a "preferred" position relative to the NMD 714 in the same manner(s) described herein. For example, if the controller CR 712 functions as a speaker-equipped device and the NMD 714 functions as the microphone-equipped device, the NMD 714 can determine the angle to and/or distance from CR 712 in the same way, or at least substantially the same way, as described above.

Figure 7C:
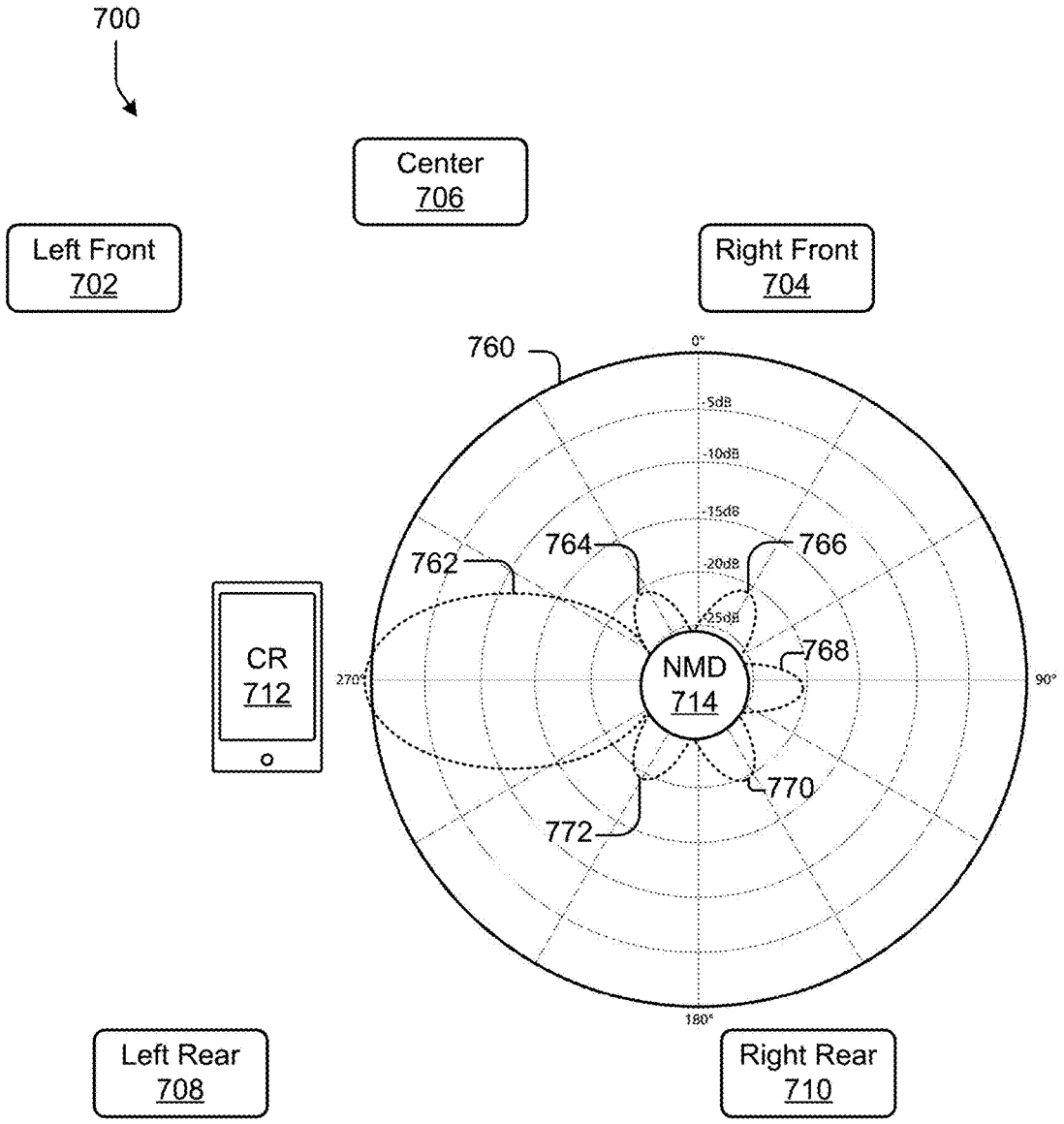
FIG. 7C shows an illustration of using the position information obtained in the procedures described with reference to FIGS. 7A and/or 7B to configure beamforming parameters for a microphone array of a networked microphone device.

FIG. 7C shows an illustration of using the position information obtained in the procedures described with reference to FIGS. 7A and/or 7B to configure beamforming parameters for a microphone array of the NMD 714.

Polar diagram 760 in FIG. 7C shows how the NMD 714 is configured to generally attenuate sounds originating from the general directions of the playback devices but generally amplify sound originating from the direction of a "preferred" location, indicated by the position of controller CR 714. For example, polar diagram 760 shows that the beamforming microphone array of the NMD 714 generally (i) attenuates sound originating from approximately 30° in the direction 766 of right front 704 playback device, (ii) attenuates sound originating from approximately 150° in the direction 770 of right rear 710 playback device, (iii) attenuates sound originating from approximately 210° in the direction 772 of left rear 708 playback device, (iv) attenuates sound originating from approximately 330° in the direction 764 of center 706 playback device, and (v) amplifies sound originating from approximately 270° in the direction 762 of controller CR 712.

In some embodiments, the media playback system 700 (or at least one or more components thereof) additionally or alternatively uses the determined relative position information for the media playback devices 702-710 and NMD 714 to identify a direction of sound originating from another set of one or more playback devices (not shown) in an adjacent room. For example, FIG. 7C assumes the media playback system 700 (or at least NMD 714) has determined that sound originating from approximately 90° in the direction 768 was generated by a set of one or more other playback devices (not shown) in an adjacent room (not shown). In operation, media playback system 700 (or at least one or more components thereof) can determine the position of the set of one or more other playback devices (not shown) relative to the NMD 714 in the manner described herein. In one example, NMD 714 determines (i) the angle of the set of one or more other playback devices relative to NMD 714 according to Equation 1 and/or (ii) the distance between the set of one or more other playback devices and NMD 714 according to Equation 2.

Additionally, in some embodiments, the microphone-equipped device may be a first playback device of the media playback system 700, and the speaker-equipped device may be a second playback device of the media playback system 700. For example, the speaker-equipped device may be left front 702 playback device and the microphone-equipped device may be right front 704 playback device. In such embodiments, the media playback system (or one or more components thereof, including but not limited to right front 704 playback device) determines the position of the left front 702 playback device based on test sound(s) emitted from the left front playback device. In operation, the right front 704 playback device may determine the position of left front 702 playback device according to Equations 1 and 2, as described herein. In some embodiments, each of the other playback devices 706-710 may also determine the position of left front 702 playback device based on the test sound(s) emitted from the left front playback back in the same or substantially the same way.

Figure 8:
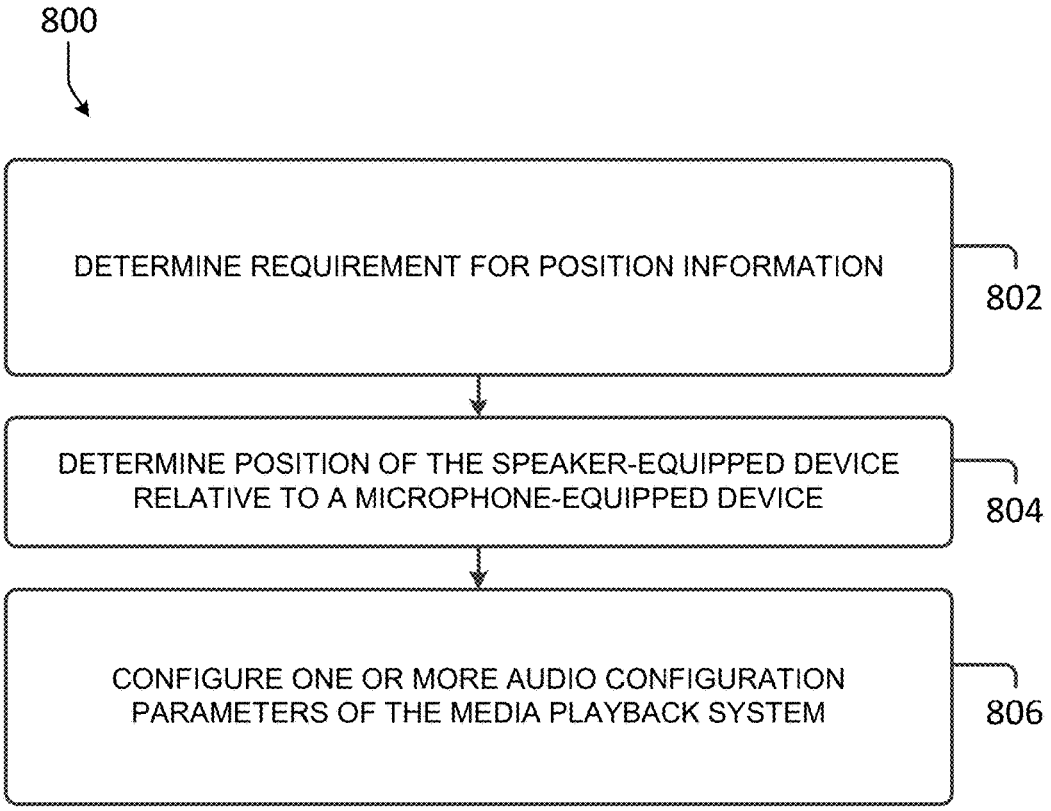
FIG. 8 shows a method 800 that can be implemented within an operating environment including or involving, for example, the media playback system 100 of FIG. 1, one or more playback devices 200 of FIG. 2, one or more control devices 300 of FIG. 3, the user interface of FIG. 4, the configuration shown in FIG. 5, the NMD shown in FIG. 6, and/or the media playback system 700 shown in FIGS. 7A-C.

FIG. 8 shows a method 800 that can be implemented within an operating environment including or involving, for example, the media playback system 100 of FIG. 1, one or more playback devices 200 of FIG. 2, one or more control devices 300 of FIG. 3, the user interface of FIG. 4, the configuration shown in FIG. 5, the NMD shown in FIG. 6, and/or the media playback system 700 shown in FIGS. 7A-C. Method 800 may include one or more operations, functions, or actions as illustrated by one or more of blocks 802-806. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 800 and other processes and methods disclosed herein, the flowchart shows functionality and operation of one possible implementation of some embodiments. In this regard, each block may represent a module, a segment, or a portion of program code, which includes one or more instructions executable by one or more processors for implementing specific logical functions or steps in the process. The program code may be stored on any type of computer readable medium, for example, such as a storage device including a disk or hard drive. The computer readable medium may include non-transitory computer readable medium, for example, such as tangible, non-transitory computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 800 and other processes and methods disclosed herein, each block in FIG. 8 may represent circuitry that is wired to perform the specific logical functions in the process.

Method 800 begins at block 802, which includes determining a requirement for position information of a speaker-equipped device within a room in which a media playback system is located. In some embodiments, block 802 may be performed by a microphone-equipped device. In operation, the speaker-equipped device is one of a playback device of the media playback system, a controller of the media playback system, or a networked microphone device, and the microphone-equipped device is one of a playback device of the media playback system, a controller of the media playback system, or a networked microphone device, as described herein with reference to FIGS. 7A-7C.

In some embodiments, determining a requirement for position information of the speaker-equipped device comprises receiving a command to configure surround sound processing parameters of the media playback system based on a position of the controller, as described herein with reference to FIGS. 7A-7C. In other embodiments, determining a requirement for position information of the speaker-equipped device in the media playback system comprises receiving a command for the first playback device to form a stereo pair with a second playback device of the media playback system, as described herein with reference to FIGS. 7A-7C.

In still further embodiments, determining a requirement for position information of the speaker-equipped device in the media playback system comprises receiving a command to initiate a spatial calibration procedure for the media playback system, where the spatial calibration procedure comprises one or more playback devices playing one or more audio calibration sounds, as described herein with reference to FIGS. 7A-7C.

In still further embodiments, determining a requirement for position information of the speaker-equipped device in the media playback system comprises receiving a command to configure a beamforming microphone array of a networked microphone device based at least in part on a location of one or more playback devices relative to the networked microphone device, as described herein with reference to FIGS. 7A-7C.

Next, method 800 advances to block 804, which includes determining a position of the speaker-equipped device relative to one or more microphone-equipped devices based at least in part on a test sound emitted from the speaker-equipped device.

In some embodiments, the step of determining a position of the speaker-equipped device relative to the one or more microphone-equipped devices based at least in part on a test sound emitted from the speaker-equipped device is performed after the step of determining the requirement for position information of the speaker-equipped device in method block 802. But in some embodiments, the step of determining a position of the speaker-equipped device relative to the one or more microphone-equipped devices based at least in part on a test sound emitted from the speaker-equipped device is performed in response to the step of determining the requirement for position information of the speaker-equipped device in method block 802.

In some embodiments, determining a position of the speaker-equipped device relative to one or more microphone-equipped devices based at least in part on a test sound emitted from one or more of the microphone-equipped devices comprises determining at least one position of the controller relative to one or more of the one or more playback devices. In some embodiments the at least one position is a user's "preferred" position in a room where the user typically watches movies, television, or other media with surround sound encoded content, as described herein. Additionally or alternatively, the at least one position is a user's "preferred" position in a room where the user typically listens to stereo encoded media content, as described herein. The preferred position for surround sound listening might be the same as or different than the preferred position for stereo listening.

In further embodiments, determining a position of the speaker-equipped device relative to one or more microphone-equipped devices based at least in part on a test sound emitted from the microphone-equipped device comprises determining multiple positions of the controller relative to one or more of the one or more playback devices as the controller device is moved through a room in which the media playback system is located during a spatial calibration procedure, as described herein with reference to FIGS. 7A-7C.

In still further embodiments, determining a position of the speaker-equipped device relative to one or more microphone-equipped devices comprises determining the position of the controller relative to one or more networked microphone devices, as described herein with reference to FIGS. 7A-7C. Such embodiments may additionally or alternatively include determining the position of one or more playback devices relative to at least one networked microphone device, as described herein with reference to FIGS. 7A-7C.

In some embodiments, determining a position of the speaker-equipped device relative to one or more microphone-equipped devices based at least in part on the test sound(s) emitted from the speaker-equipped device comprises determining (i) an angle of the speaker-equipped device relative to at least one microphone-equipped device and (ii) a distance between the speaker-equipped device and the at least one microphone-equipped device. In embodiments where the media playback system includes multiple playback devices, the step of determining a position of the speaker-equipped device relative to one or more microphone-equipped devices based at least in part on the test sound(s) emitted from the speaker-equipped device in method block 804 may include determining (i) an angle of the speaker-equipped device relative to each individual playback device and (ii) a distance between the speaker-equipped device and each individual playback device.

In some embodiments, determining the angle of the speaker-equipped device relative to the microphone-equipped device comprises solving for Equation 1, as described herein. And in some embodiments, determining the distance between the speaker-equipped device and the microphone-equipped device comprises solving for Equation 2, as described herein. In some embodiments, the device clocks of the speaker-equipped device and the one or more microphone-equipped devices are synchronized to a single-sample accuracy. Rather than synchronizing the device clocks, some embodiments may include deriving reference timing information from a synchronous media playback protocol implemented by two or more speaker-equipped devices, as disclosed herein.

Finally, method 800 advances to block 806, which includes configuring one or more audio configuration parameters of the media playback system based at least in part on the position of the speaker-equipped device relative to the one or more microphone-equipped devices. In some embodiments, the step of configuring one or more audio configuration parameters of the media playback system based at least in part on the position of the speaker-equipped device relative to the one or more microphone-equipped devices of block 806 is performed after the step of determining the position of the speaker-equipped device relative to the one or more microphone-equipped devices of block 804. In other embodiments, the step of configuring one or more audio configuration parameters of the media playback system based at least in part on the position of the speaker-equipped device relative to the one or more microphone-equipped devices of block 806 is performed in response to completing the step of determining the position of the speaker-equipped device relative to the one or more microphone-equipped devices of block 804.

In some embodiments, configuring one or more audio configuration parameters of the media playback system based on the position of the speaker-equipped device relative to the one or more microphone-equipped devices comprises configuring one or more of an equalization, volume, gain, surround sound delay processing parameter, stereo delay processing parameter, balance, fading, and/or other audio configuration parameter for one or more speakers and/or amplifiers of one or more of the playback devices of the media playback system. In some embodiments, configuring one or more of an equalization, volume, gain, surround sound delay processing parameter, stereo delay processing parameter, balance, fading, and/or other audio configuration parameter for one or more speakers and/or amplifiers of one or more of the playback devices of the media playback system is based on one or more "preferred" listening locations indicated by a user of the media playback system. For example, and as described herein with reference to FIGS. 7A-C, the equalization, volume, gain, surround sound delay processing parameter, stereo delay processing parameter, balance, fading, and/or other audio configuration parameters are configured based on one or both of a preferred surround sound and/or stereo listening location. The equalization, volume, gain, surround sound delay processing parameter, stereo delay processing parameter, balance, fading, and/or other audio configuration parameters could be configured based on other designed preferred listening locations as well.

In still further embodiments, configuring one or more audio configuration parameters of the media playback system based on the position of the speaker-equipped device relative to one or more of the microphone-equipped devices in block 806 comprises configuring a beamforming microphone array of one or more microphone-equipped devices to (i) attenuate sound originating from one or more directions where speaker-equipped devices are emitting sound and/or (ii) amplify sound originating from one or more directions corresponding to one or more preferred locations, as described in detail herein with reference to FIGS. 7A-C.

For example, the relative positioning information of the devices in the media playback system can be used to configure a beamforming microphone array of a networked microphone device to (i) attenuate sound originating from locations where playback devices are located and (ii) amplify sound originating from "preferred" listening locations where users are likely to be sitting and listening to music or watching television or movies. The "preferred" listening locations are locations where users are also likely to be speaking voice commands to control the media playback system and/or perhaps other systems. Similarly, for embodiments where one or more individual playback devices have a beamforming microphone array, the relative positioning information of the devices in the media playback system can be used to configure each beamforming microphone array of each playback device (or each playback device having a beamforming microphone array) to (i) attenuate sound originating from locations where the other playback devices are located and (ii) amplify sound originating from "preferred" listening locations where users are likely to be sitting and listening to music or watching television or movies.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

I claim:

1. A media playback system, comprising:
- a control device comprising a first transducer;
- a playback device comprising a second transducer;
- a network microphone device including:
  - a microphone array;
  - one or more processors; and;
  - tangible, non-transitory, computer-readable media storing instructions that, when executed by one or more processors, cause the network microphone device to perform operations comprising:
    - determining a first direction of the control device with respect to the network microphone device based at least in part on a first test sound received at the microphone array from the first transducer;
    - determining a second direction of the playback device with respect to the network microphone device based at least in part on a second test sound received at the microphone array from the second transducer; and
    - adjusting one or more beamforming parameters of the microphone array, wherein adjusting the one or more beamforming parameters causes the networking microphone device to amplify sound received at the microphone array from the first direction, and further causes the networking microphone device to attenuate sound received at the microphone array from the second direction.

2. The media playback system of claim 1, wherein the instructions further include instructions for performing operations comprising:
- receiving a command to configure surround sound processing parameters of the media playback system based at least in part on a position of the control device with respect to the network microphone device; and
- in response to the received command, adjusting at least one of a volume parameter and a delay processing parameter of the playback device.

3. The media playback system of claim 1, wherein the playback device is a first playback device, the media playback system further comprising:
- a second playback device, wherein the second playback device comprises the networking microphone device, and wherein the instructions further include instructions for performing operations comprising:
  - receiving a command for the first playback device to form a stereo pair with the second playback device.

4. The media playback system of claim 1, wherein the playback device is positioned in a room, and wherein the instructions further include instructions for performing operations comprising:
- receiving a command to initiate a spatial calibration procedure for the media playback system, wherein the spatial calibration procedure comprises:

playing back one or more audio calibration tones via the playback device, and determining multiple positions of the control device relative to the playback device as the control device is moved through the room.

5. The media playback system of claim 4, wherein the instructions further include instructions for performing operations comprising:

selecting a preferred position from the multiple determined positions of the controller device; and adjusting at least one of a volume parameter and delay processing parameters of the media playback system based on the selected preferred position.

6. The media playback system of claim 1, wherein the playback device is a first playback device, further comprising:

a second playback device comprising a third transducer, wherein the instructions further include instructions for performing operations comprising:

determining a third direction of the second playback device with respect to the network microphone device based at least in part on a third test sound received at the microphone array from the third transducer, wherein adjusting the one or more beamforming parameters further comprises causing the networking microphone device to attenuate sound received at the microphone array from the third direction.

7. The media playback system of claim 1, wherein the instructions further include instructions for performing operations comprising:

determining a first position of the control device with respect to the network microphone device based at least in part on the first test sound; and determining a second position of the playback device with respect to the network microphone device based at least in part on the second test sound.

8. The media playback system of claim 7, wherein the instructions further include instructions for performing operations comprising:

receiving, from the playback device, a message comprising a timestamp indicating a first time when the first test sound emitted from the control device; and determining a second time corresponding to an arrival time of the first test sound at the network microphone device, wherein determining the first position further comprises determining a difference between the first and second times.

9. The media playback system of claim 1, further comprising:

a first microphone and a second microphone, wherein the first and second microphones are housed in the network microphone device, and wherein the instructions for determining the first direction of the control device further comprise determining a difference of (i) a first arrival time of the first test sound at the first microphone, and (ii) a second arrival time of the first test sound at the second microphone.

10. The media playback system of claim 1, further comprising:

a first device clock, wherein the network microphone device comprises the first device clock; and a second device clock, wherein the control device comprises the second device clock, wherein the instructions further include instructions for synchronizing the first and second device clocks.

11. A network microphone device including:

a microphone array;

one or more processors; and;

tangible, non-transitory, computer-readable media storing instructions that, when executed by one or more processors, cause the network microphone device to perform operations comprising:

determining a first direction of a control device of a media playback system with respect to the network microphone device based at least in part on a first test sound received at the microphone array from the control device;

determining a second direction of a playback device with respect to the network microphone device based at least in part on a second test sound received at the microphone array from the playback device; and adjusting one or more beamforming parameters of the microphone array, wherein adjusting the one or more beamforming parameters causes the networking microphone device to amplify sound received at the microphone array from the first direction, and further causes the networking microphone device to attenuate sound received at the microphone array from the second direction.

12. The network microphone device of claim 11, wherein the instructions further include instructions for performing operations comprising:

receiving a command to configure surround sound processing parameters of the media playback system based at least in part on a position of the control device with respect to the network microphone device; and in response to the received command, adjusting at least one of a volume parameter and a delay processing parameter for the playback device.

13. The network microphone device of claim 11, wherein the playback device is positioned in a room, and wherein the instructions further include instructions for performing operations comprising:

receiving a command to initiate a spatial calibration procedure for the media playback system, wherein the spatial calibration procedure comprises:

playing back one or more audio calibration tones via the playback device, and determining multiple positions of the control device relative to the playback device as the control device is moved through the room.

14. The network microphone device of claim 13, wherein the instructions further include instructions for performing operations comprising:

selecting a preferred position from the multiple determined positions of the controller device; and adjusting at least one of a volume parameter and delay processing parameters of the media playback system based on the selected preferred position.

15. The network microphone device of claim 11, wherein the instructions further include instructions for performing operations comprising:

determining a first position of the control device with respect to the network microphone device based at least in part on the first test sound; and determining a second position of the playback device with respect to the network microphone device based at least in part on the second test sound.

16. The network microphone device of claim 11, further comprising:

a first microphone and a second microphone, wherein the instructions for determining the first direction of the control device further comprise determining a difference of (i) a first arrival time of the first test sound at the first microphone, and (ii) a second arrival time of the first test sound at the second microphone.

17. A method of operating a network microphone device having a microphone array, the method comprising:

determining a first direction of a control device of a media playback system with respect to the network microphone device based at least in part on a first test sound received at the microphone array from the control device;

determining a second direction of a playback device with respect to the network microphone device based at least in part on a second test sound received at the microphone array from the playback device; and adjusting one or more beamforming parameters of the microphone array, wherein adjusting the one or more beamforming parameters causes the networking microphone device to amplify sound received at the microphone array from the first direction, and further causes the networking microphone device to attenuate sound received at the microphone array from the second direction.

18. The method of claim 17, further comprising:

receiving a command to configure surround sound processing parameters of the media playback system based at least in part on a position of the control device with respect to the network microphone device; and in response to the received command, adjusting at least one of a volume parameter and a delay processing parameter for the playback device.

19. The method of claim 17, further comprising:

receiving a command to initiate a spatial calibration procedure for the media playback system, wherein the spatial calibration procedure comprises:

playing back one or more audio calibration tones via the playback device, and determining multiple positions of the control device relative to the playback device as the control device is moved through a room in which the playback device is positioned.

20. The method of claim 17, further comprising:

determining a first position of the control device with respect to the network microphone device based at least in part on the first test sound; and determining a second position of the playback device with respect to the network microphone device based at least in part on the second test sound.

* * * * *